US006690911B2

(12) United States Patent
Yamagishi

(10) Patent No.: US 6,690,911 B2
(45) Date of Patent: Feb. 10, 2004

(54) SHEET REVERSING AND DISCHARGING DEVICE AND IMAGE FORMING APPARATUS USING THE SAME

(75) Inventor: Masaru Yamagishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/090,994

(22) Filed: Mar. 6, 2002

(65) Prior Publication Data

US 2002/0127039 A1 Sep. 12, 2002

(30) Foreign Application Priority Data

Mar. 6, 2001 (JP) ..... 2001-061562
Feb. 5, 2002 (JP) ..... 2002-028411

(51) Int. Cl.[7] ..... G03G 15/00

(52) U.S. Cl. ..... 399/405; 399/389; 399/45; 271/9.06

(58) Field of Search ..... 271/9.05, 9.06, 271/264, 265.01, 265.02; 399/16, 23, 45, 381, 382, 389, 391, 363, 405

(56) References Cited

U.S. PATENT DOCUMENTS 5,655,207 A 8/1997 Sugiyama et al.
5,722,029 A * 2/1998 Tomidokoro et al. ..... 399/389

FOREIGN PATENT DOCUMENTS

JP 8-133587 5/1996
JP 11-43265 2/1999
JP 2000-16663 1/2000
JP 2001-19211 1/2001

OTHER PUBLICATIONS

Patent Abstracts of Japan, JP 2000–318902, Nov. 21, 2000.
Patent Abstracts of Japan, JP 10–29751, Feb. 3, 1998.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A sheet reversing and discharging device of the present invention conveys each of a tab sheet and an ordinary sheet in a particular manner. Before a tab sheet enters a reversal tray, a drive roller is driven in the reverse direction while a driven roller is lowered into contact with the drive roller beforehand. The drive roller and driven roller pull in the tab sheet in the direction of conveyance until the tab of the tab sheet moves away from the tip of a path selector. The drive roller and driven roller surely convey the tab sheet to the reversal tray after the tab has moved away from the above tip. Whether or not the tab has moved away from the tip is determined on the basis of a period of time elapsed since a sheet sensor adjoining the inlet of the device has sensed the trailing edge of the tab sheet.

49 Claims, 18 Drawing Sheets

SHEET REVERSING AND DISCHARGING DEVICE AND IMAGE FORMING APPARATUS USING THE SAME

BACKGROUND OF THE INVENTION

1. Field of the Invention

The present invention relates to a sheet reversing and discharging device constructed to convey each of a tab sheet and an ordinary sheet in a particular manner, and an image forming apparatus using the same.

2. Description of the Background Art

Today, a printer, copier or similar image forming apparatus operable in a tab sheet mode is available. In the tab sheet mode, a tab sheet is inserted between ordinary printing or copying cycles in order to divide consecutive jobs. In a copier, for example, a tab sheet is conveyed with its edge opposite to an edge where a tab is present at the head, so that the tab does not obstruct conveyance. On the other hand, when the tab sheet is used as a slip sheet, it is necessary to reverse the tab sheet being conveyed with the tab at the head before discharging the tab sheet to a tray.

Japanese Patent Laid-Open Publication No. 3-107454, for example, discloses a device for reversing and then conveying a tab sheet. The device includes a path selector positioned at a branch portion on a conveyance path arranged in an image forming apparatus. The path selector, which is angularly movable, switches a direction in which a sheet should be conveyed, thereby delivering the sheet to a desired path. More specifically, the path selector nips a sheet between it and a roller positioned on a reversal path and is biased to exert a conveying force on the sheet. After the conveyance of the sheet, the bias acting on the path selector moves the path selector and thereby reverses the sheet. The path selector therefore contributes not only to path switching but also to sheet conveyance.

While an improvement over the device described above has been proposed, it has some problems left unsolved, as will be described specifically later.

As for control, the timing for reversal should be delayed by the length of the tab sheet in the direction of conveyance, resulting in low productivity. Specifically, Japanese Patent Laid-Open Publication No. 2000-16663 addresses to a problem to arise when a tab sheet is reversed by using the output of a sensor response to the trailing edge of the tab sheet as a trigger. Specifically, when the tab moves away from the sensing range of the sensor, control for reversal is apt to occur before the tab fully removes away from above range. In light of this, the above document teaches that the tab sheet is reversed with a margin in timing corresponding to the length of the tab after the sensor has sensed the trailing edge of the tab sheet.

While the margin taught in the above Laid-Open Publication No. 2000-16663 implements reliable conveyance, it delays the timing for reversal by the length of the tab after the sensor has sensed the trailing edge of the tab, again resulting in low productivity. To maintain high productivity, there may be sensed both of the leading edge and trailing edge of the tab sheet so as to calculate an exact timing for reversal on the basis of a length between the two edges. However, this kind of scheme is not practicable without resorting to sophisticated control.

Technologies relating to the present invention are also disclosed in, e.g., Japanese Patent Laid-Open Publication Nos. 8-133587, 11-43265, and 2001-19211.

SUMMARY OF THE INVENTION

It is an object of the present invention to provide a sheet reversing and discharging device capable of reliably conveying even a tab sheet and an image forming apparatus using the same.

It is another object of the present invention to provide a sheet reversing and discharging device capable of insuring high productivity even with a tab sheet and an image forming apparatus using the same.

It is yet another object of the present invention to provide a sheet reversing and discharging device capable of setting a timing for reversal with simple control.

It is a further object of the present invention to provide a sheet reversing and discharging method having the above advantages.

In accordance with the present invention, a method of reversing an incoming sheet and then discharging it uses a reversal path for receiving a sheet carrying an image on one side thereof and then reversing the sheet, delivering members for delivering the sheet to the reversal path, and conveying members arranged on the reversal path for reversing the sheet delivered by the delivering members and then conveying the sheet. If the sheet is a tab sheet, the tab sheet is reversed in accordance with a time when the leading edge of the tab sheet is sensed. On the other hand, if the sheet is not a tab sheet, the sheet is reversed in accordance with a time when the trailing edge of sheet is sensed.

Also, in accordance with the present invention, a device for reversing a sheet and then discharging it includes a reversal path for receiving a sheet carrying an image on one side thereof and then reversing it. Delivering members adjoin the inlet of the reversal path for delivering the sheet to the reversal path. Conveying members are implemented as a drive roller and a driven roller for selectively further pulling the sheet entered the reversal path into the reversal path or conveying the sheet out of the reversal path after receiving the sheet. A drive source drives the drive roller. A controller causes, if the sheet is a tab sheet, the drive source to continuously drive the drive roller in a send-in direction until the tab of the sheet moves away from the delivering members or causes, if the sheet is not a tab sheet, the drive source to drive the drive roller in a send-out direction both when the sheet is sent in and when the sheet is sent out.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
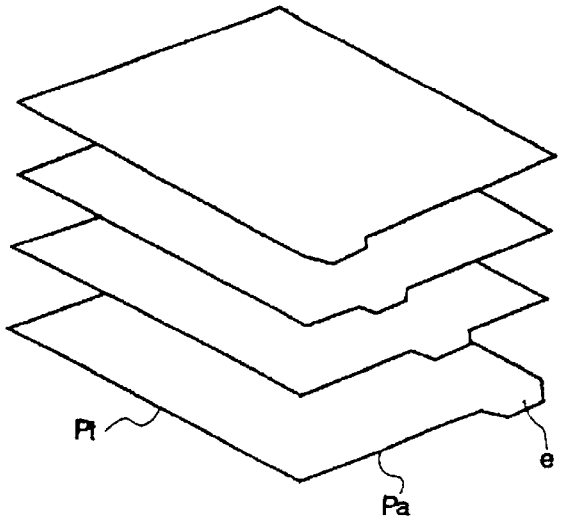
FIG. 1 PRIOR ART
FIG. 1 is a perspective view showing specific tab sheets to be dealt with by the present invention.

FIG. 1 shows specific tab sheets Pt to which the present invention is applied. As shown, each tab sheet Pt has a tab e protruding from part of one edge Pa. A caption, for example, is printed or written on the tab e, so that the tab sheet Pt facilitates filing. In a copier, for example, the tab sheet Pt is conveyed with the edge opposite to the edge where the tab e is present at the head, so that the tab e does not obstruct conveyance. On the other hand, when the tab sheet Pt is used as a slip sheet, it is necessary to reverse the tab sheet Pt being conveyed with the tab e at the head before discharging the tab sheet Pt to a tray.

Further, when the tab sheet Pt is driven out to the above tray, the tab e is positioned at the upstream side in the direction of conveyance (trailing edge side). Therefore, when the tab sheet Pt is returned by gravity into abutment against a rear fence and positioned thereby, the tab e abuts against the rear fence, causing the tab sheet Tb to tilt. Moreover, when the tab sheets Pt are used as slip sheets, the tabs e of the sheets Pt are, in many cases, different in position from each other, and each causes the respective sheet Pt to tilt in a particular position on the tray. In this case, it is necessary to reverse each tab sheet Pt such that the tab e is positioned at the downstream side in the direction of conveyance on the tray and allows the straight edge of the sheet Pt to abut against the rear fence.

Figure 2:
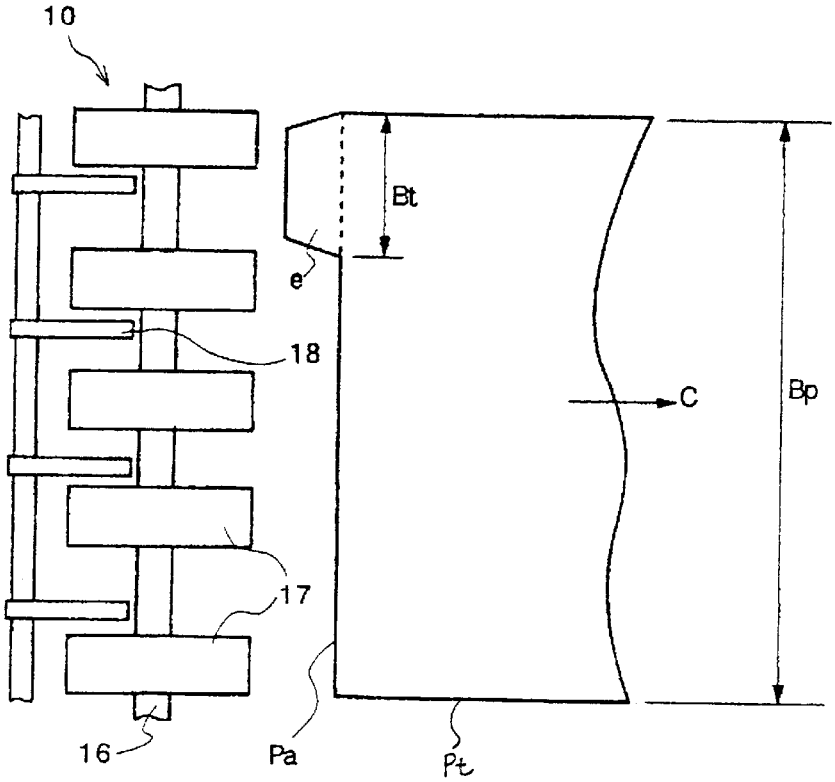
FIG. 2 PRIOR ART
FIG. 2 is a fragmentary plan view showing the inlet portion of a conventional sheet reversing and discharging device capable of dealing with tab sheets.

A system for reversing the tab sheet Pt is disclosed in Laid-Open Publication No. 3-107454 mentioned earlier. FIG. 2 shows a conventional arrangement constituting an improvement over the system of the above document. As shown, the arrangement includes a roller 10 for conveying a sheet to a switchback section or reversal tray. To insure the conveyance of the tab sheet Pt, the roller 10 is implemented as a plurality of rollers 17 mounted on a shaft 16. Fingers 18, which constitute a path selector, are positioned such that their tips each are positioned between nearby rollers 17. In this configuration, the tab e of the tab sheet Pt contacts any one of the rollers 17 without fail and is conveyed in a direction indicated by an arrow C thereby.

However, the problem with the arrangement shown in FIG. 2 is that the width Bp of the tab sheet Pt and the width Bt and position of the tab e are open to choice. Therefore, the roller 10 cannot deal with such various kinds of tab sheets Pt unless it includes a great number of rollers 17, resulting in an increase in cost. Moreover, a great number of rollers 17 bring about a problem that they are apt to contact the corners and both sides of a sheet by accident and thereby obstruct reliable conveyance.

Preferred embodiments of the image forming apparatus in accordance with the present invention will be described hereinafter. In the illustrative embodiments, structural elements identical with the elements shown in FIGS. 1 and 2 are designated by identical reference numerals and will not be described-specifically in order to avoid redundancy.

Figure 3:
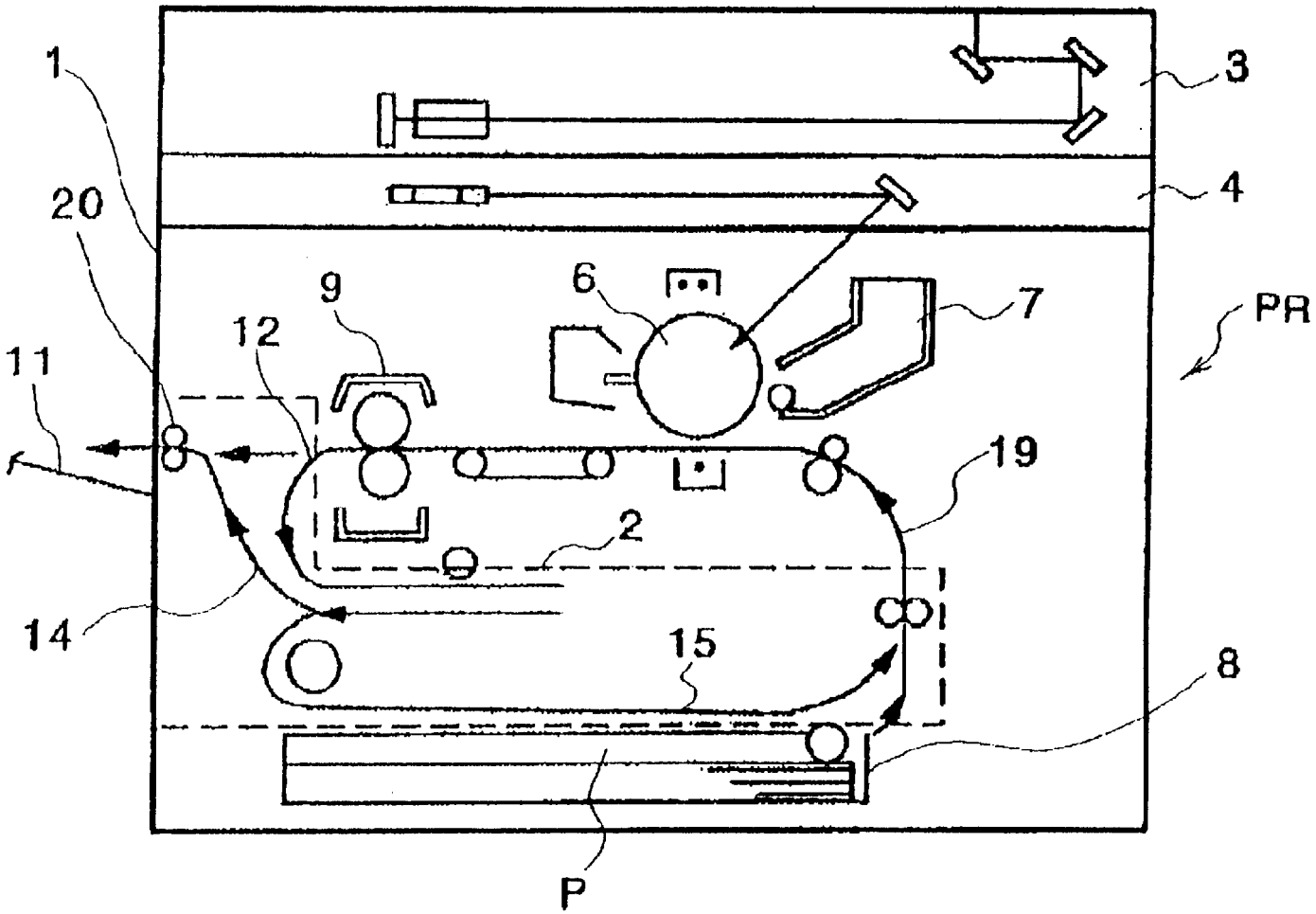
FIG. 3 is a view showing an image forming apparatus embodying the present invention.

Referring to FIG. 3, an image forming apparatus embodying the present invention is shown and generally labeled PR. As shown, the apparatus PR is implemented as an electrophotographic image forming apparatus and generally made up of an image forming device 1, a sheet reversing and discharging device 2, a image reading device 3, an image writing device 4, a sheet feeding device 8, and a fixing device 9. The image forming device 1 includes a photoconductive drum, a charger, a developing unit, an image transfer unit, and a cleaning unit as usual. The sheet reversing and discharging device 2 reverses and then discharges a sheet or recording medium. The image reading device 3 optically reads a document laid on a glass platen, not shown, which is positioned on the top of the reading device 3. The resulting reflection from the document is converted to image data. The image writing device 4 optically scans the charged surface of the photoconductive drum, labeled 6, in accordance with the image data, thereby forming a latent image. The developing device develops the latent image with toner to thereby form a corresponding toner image. A sheet P fed from the sheet feeding device 8 is conveyed to the image forming device 1, as indicated by an arrow 19. In the image forming device 1, the image transfer unit 5 transfers the toner image from the drum 6 to the sheet P. The fixing device 9 fixes the toner image on the sheet P. The sheet P coming out of the fixing device 9 is driven out to a tray 11 or steered to the sheet reversing and discharging device 2.

The sheet reversing and discharging device 2 drives the sheet P out of the apparatus PR without reversing it or again conveys it toward the image forming device 1 after revering it. More specifically, the sheet P is driven out of the apparatus PR straight to the tray 11 via an outlet roller pair 20 or conveyed to the device 2 along a path 12. The sheet conveyed to the device 2 is then sent out via a path 14 and reversed thereby. In a duplex mode, the sheet P conveyed to the device 2 is again fed to the image forming device 1 via a path 15, so that a toner image can be formed on the reverse side of the sheet P.

Figure 4:
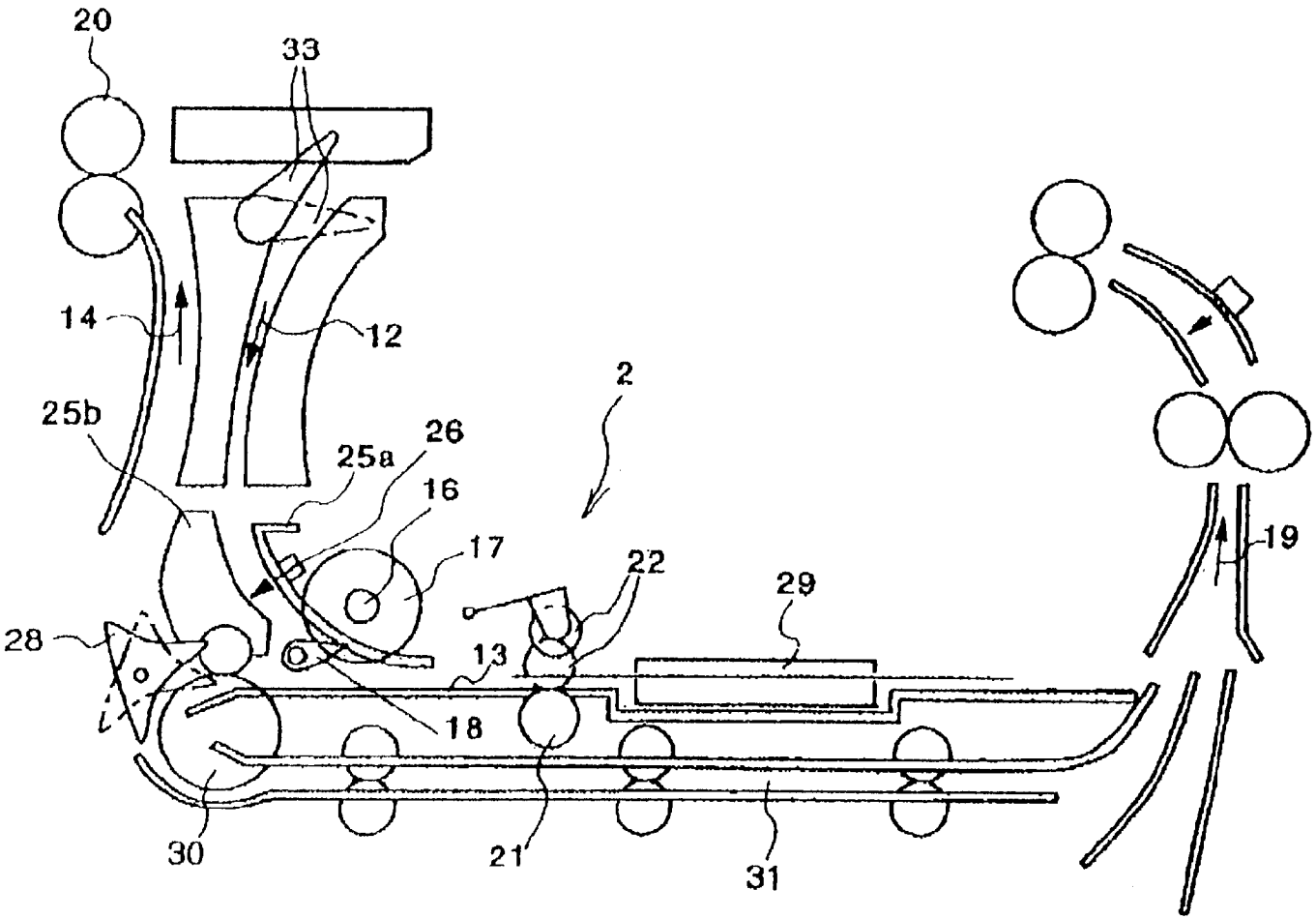
FIG. 4 is a fragmentary enlarged view showing a sheet reversing and discharging device included in the illustrative embodiment.

Reference will be made to FIG. 4 for describing the device 2 in detail. As shown, the device 2 includes a path selector 33 positioned at the most upstream side in the direction of conveyance. An upper inlet guide 25*a*, a lower inlet guide 25*b*, a sheet sensor 26, a roller 17, a path selector 18 and a guide 13 are sequentially positioned in this order downstream of the path selector 33. A drive reverse roller 21 and a driven reverse roller 22 face each other with the intermediary of the guide 13. A side fence 29 plays the role of a jogger. The device 2 additionally includes a duplex drive roller 30, a duplex path selector 28, and a reversal path 31. The path selector 33 selectively steers the sheet P coming out of the fixing device 9 and carrying the toner image on one side thereof toward the outlet roller pair 20 or the device 2. More specifically, the path selector 33 steers the sheet P toward the device 2 when in a position indicated by a solid line in FIG. 4 or steers it toward the outlet roller pair 20 when in a position indicated by a phantom line.

The sheet P steered by the path selector 33 toward the device 2 enters a path 12 between the upper inlet guide 25*a* and the lower inlet guide 25*b*. The sheet sensor 26 is mounted on the upper inlet guide 25*a* for sensing the trailing edge of the sheet P in the direction of conveyance. The roller 17 adjoins the downstream side of the sheet sensor 26 in the direction of conveyance. The path selector 18 has an end positioned below and downstream of the roller 17 in the direction of conveyance. Biasing means, not shown, constantly biases the path selector 18 upward, i.e., toward the shaft 16 of the roller 17. The roller 17 is implemented as a plurality of rollers arranged side by side in the direction perpendicular to the sheet surface of FIG. 4. Likewise, the path selector 18 is implemented as a plurality of fingers arranged side by side in the above direction. Each finger is positioned between nearby rollers of the roller 17. In this configuration, the sheet P between the roller 17 and the path selector 18 is pressed against the roller 17 by the path selector 18 and conveyed along the guide 13 thereby.

Figure 5:
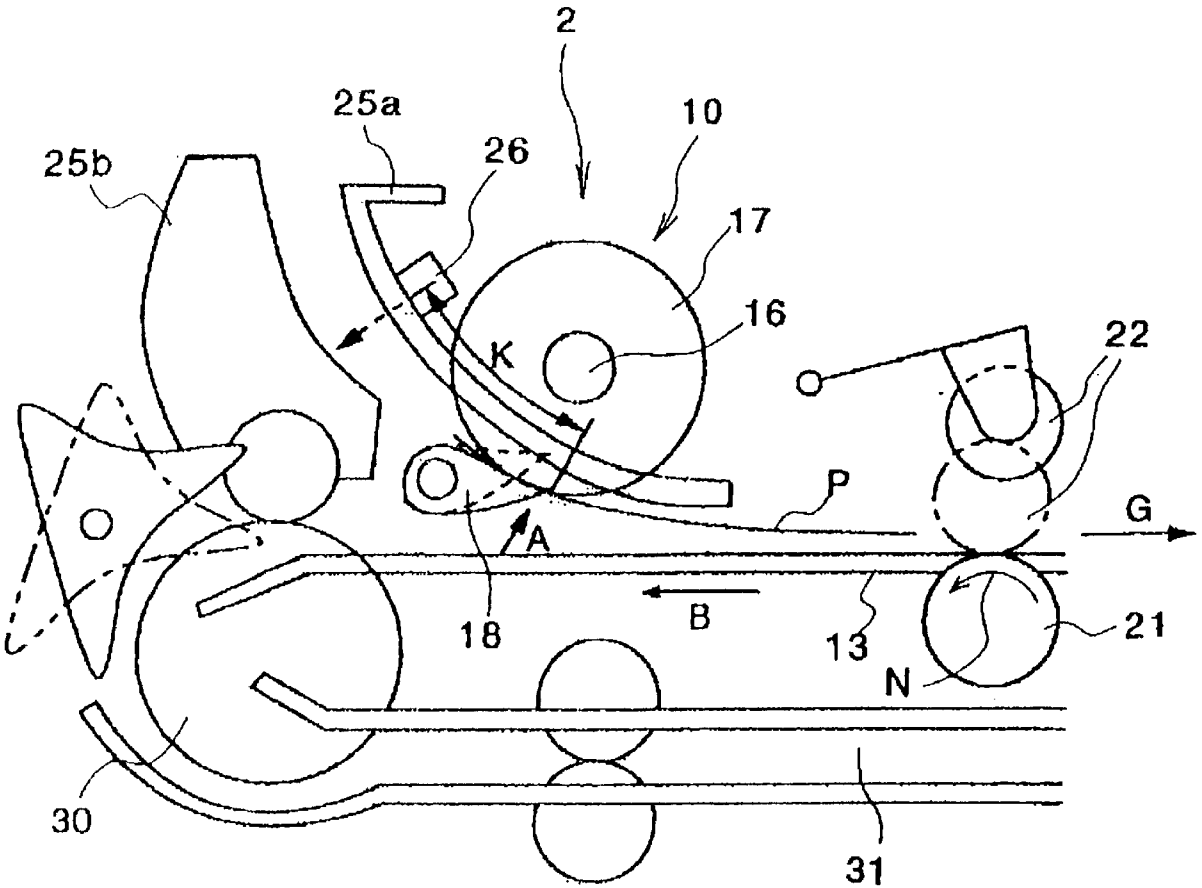
FIG. 5 is an enlarged view showing a roller and a path selector included in the sheet reversing and discharging device together with arrangements therearound.

FIG. 5 shows arrangements around the roller 17 and path selector 18 in an enlarged view. In FIG. 5, an arrow A indicates how path selector 18 acts on the sheet P entering the device 2. An arrow B indicates how the path selector 18 acts on the sheet P in the event the send-out of the sheet P. Further, an arrow G indicates the sheet P being sent into sheet reversing device 2. As shown, the roller 17 and path selector 18 sandwich the sheet P being sent into the sheet feeding device 2. At this instant, the path selector 18 presses the sheet P against the roller 17 and allows the roller 17 to convey the sheet P with a frictional force. As soon as the trailing edge of the sheet P moves away from the path selector 18, the driven reverse roller 22 is lowered toward the drive reverse roller 21. The drive roller 21 and driven roller 22 then cooperate to convey the sheet P in the reverse direction.

Figure 6:
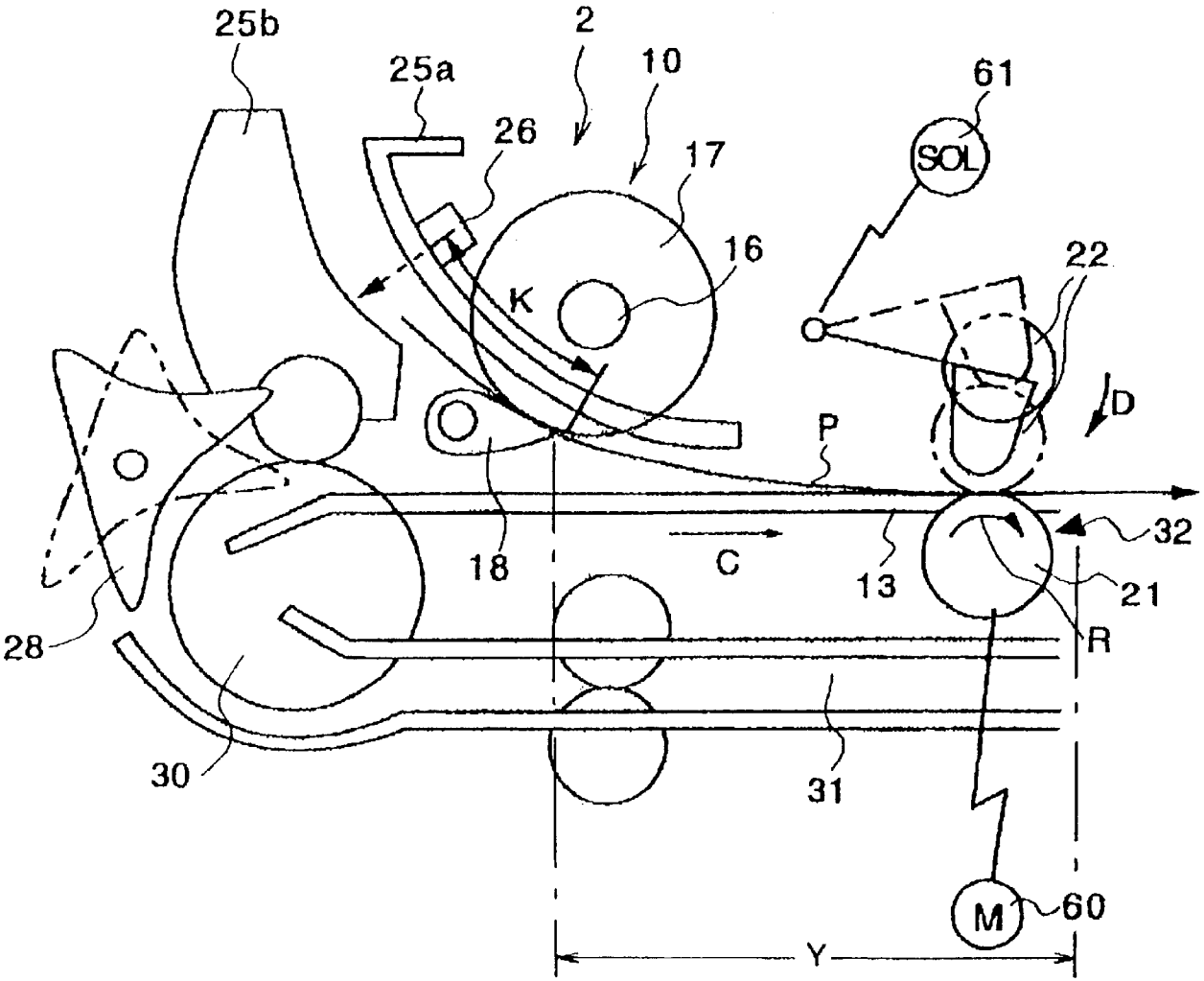
FIG. 6 is a view similar to FIG. 5, showing a modification of the illustrative embodiment.

FIG. 6 shows a modification of the illustrative embodiment. As shown, the modification differs from the illustrative embodiment in that a motor or drive source 60 is exclusively assigned to the drive reverse roller 21 and reversibly drives the roller 21 at a variable speed. The motor 60 is implemented by a stepping motor by way of example. In this configuration, before the tab sheet Pt reaches the guide (tray hereinafter) 13, the motor 60 causes the drive reverse roller 21 to rotate in the reverse direction R (send-in direction). At the same time, a solenoid 61 is energized to lower the driven reverse roller 22 in a direction indicated by an arrow D. The drive roller 21 and driven roller 22 then convey the sheet P onto the tray 13 in a direction indicated by an arrow C until the tab e of the tab sheet Pt moves away from the tip of the path selector 18.

Figure 7:
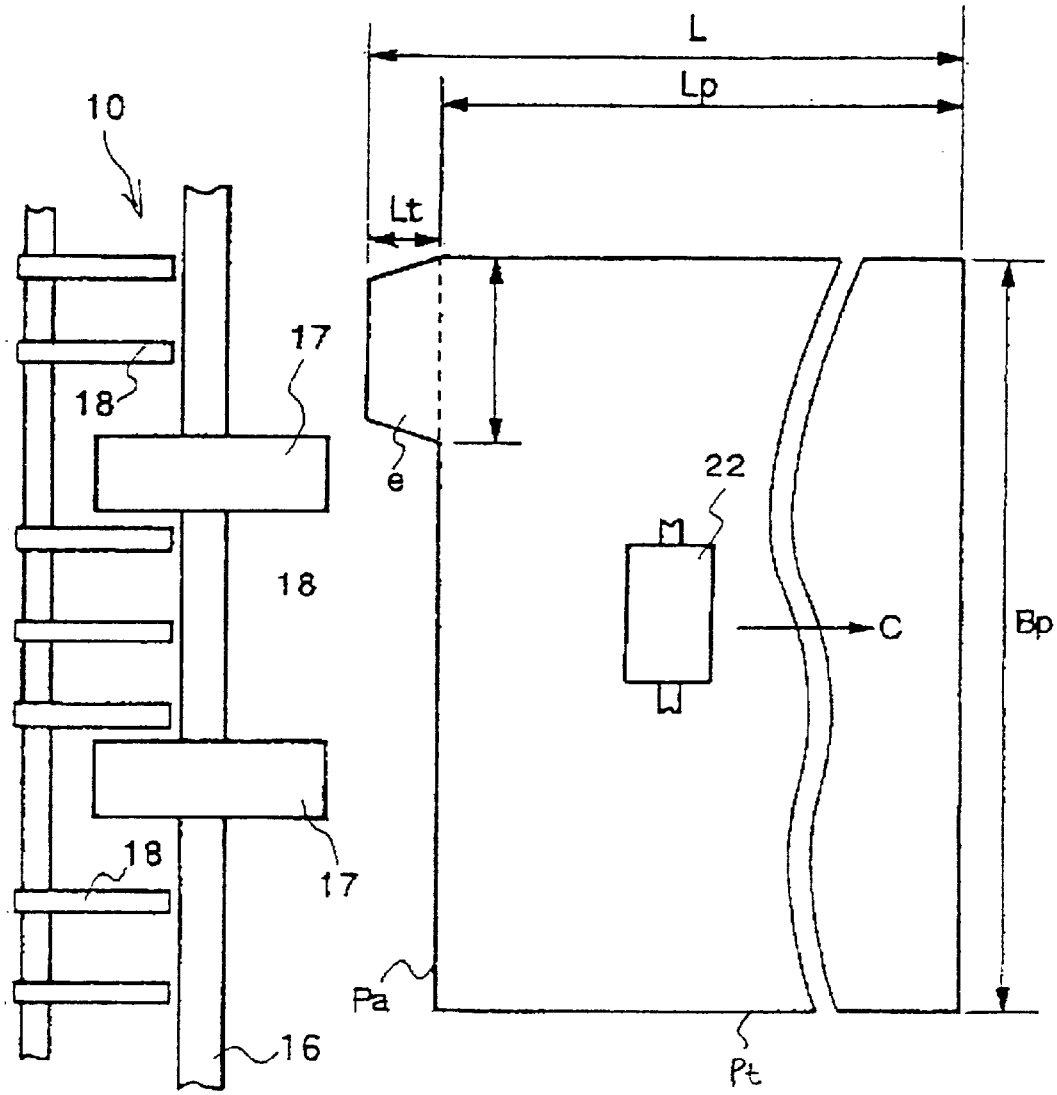
FIG. 7 is a fragmentary plan view showing the inlet portion of the sheet revering and discharging device.

The illustrative embodiment and its modification described above allow the tab eof the tab sheet Pt to surely move away from the tip of the path selector 18 even when the number of the rollers 17 is small, as shown in FIG. 7. The tab sheet Pt can therefore be surely laid on the tray 13. Whether or not the tab e has moved away from the tip of the path selector 18 (timing for reversal) is determined on the basis of a period of time to elapse since the sheet sensor 26 has sensed the tailing edge of the tab sheet Pt; the shorter the period of time, the higher the accuracy. This promotes desirable control over ordinary sheets as well.

However, a problem arises when the timing for reversal is determined by the same sequence for both of the tab sheet Pt and an ordinary sheet in order to, e.g., simplify control. Specifically, when the tab sheet Pt is conveyed with the tab e at the tail, it is difficult to sense the trailing edge of the tab sheet Pt because the position of the tab e in the direction of width (perpendicular to the direction of conveyance) is not known. As a result, in many cases, an error corresponding to the length Lt of the tab e in the direction of conveyance occurs in the period of time sensed. It is therefore necessary to delay the timing for reversal by taking account of the tab e or to increases an interval between consecutive sheets. While a plurality of sheet sensors 26 may be arranged in correspondence to the expected positions of the tabs e, this kind of scheme increases the number of sensors 26 and required sophisticated control, resulting in an increase in cost.

In light of the above, in the illustrative embodiment, the length L of the tab sheet Pt (inclusive of the length Lt of the tab e) is input beforehand. A period of time t sensed by the sheet sensor 26 is used to calculate an error as an extra amount of feed δ (corresponding to the length Lt of the tab e). The tab sheet Pt is further conveyed by the extra amount of feed δ. More specifically, assuming that the distance between the sheet sensor 26 and the tip of the path selector 18 is a preselected (usual) distance of conveyance K, then the tab sheet Pt is conveyed by an amount Kt expressed as:

$$Kt = \text{preselected distance } K + \text{extra amount } \delta \qquad \text{Eq. (1)}$$

On the other hand, when only the trailing edge of the tab sheet Pt is to be sensed, the length Lt of the tab e is input beforehand. The length Lt is added to the length of the tab sheet Pt, which is derived from sheet size information output from the sheet feeding device 8, thereby determining the length L of the tab sheet Pt. The sheet size information includes the size and orientation of the tab sheet Pt.

The actual sheet length L' sensed by the sheet sensor 26 is expressed as:

$$L' = V \times t \qquad \text{Eq. (2)}$$

where V denotes the conveyance speed of the tab sheet Pt.

Assuming that the length of the tab sheet Pt input beforehand is L, then the extra amount of feed δ corresponding to the length Lt of the tab e is produced by:

$$\delta = L - L' \qquad \text{Eq. (3)}$$

Therefore, when a sheet being sent in is determined to be a tab sheet Pt, the sheet can be more surely reversed if pulled in by the amount Kt. It follows that even a small number of rollers 17 shown in FIG. 7 suffice for reliable conveyance and cost reduction.

Figure 8:
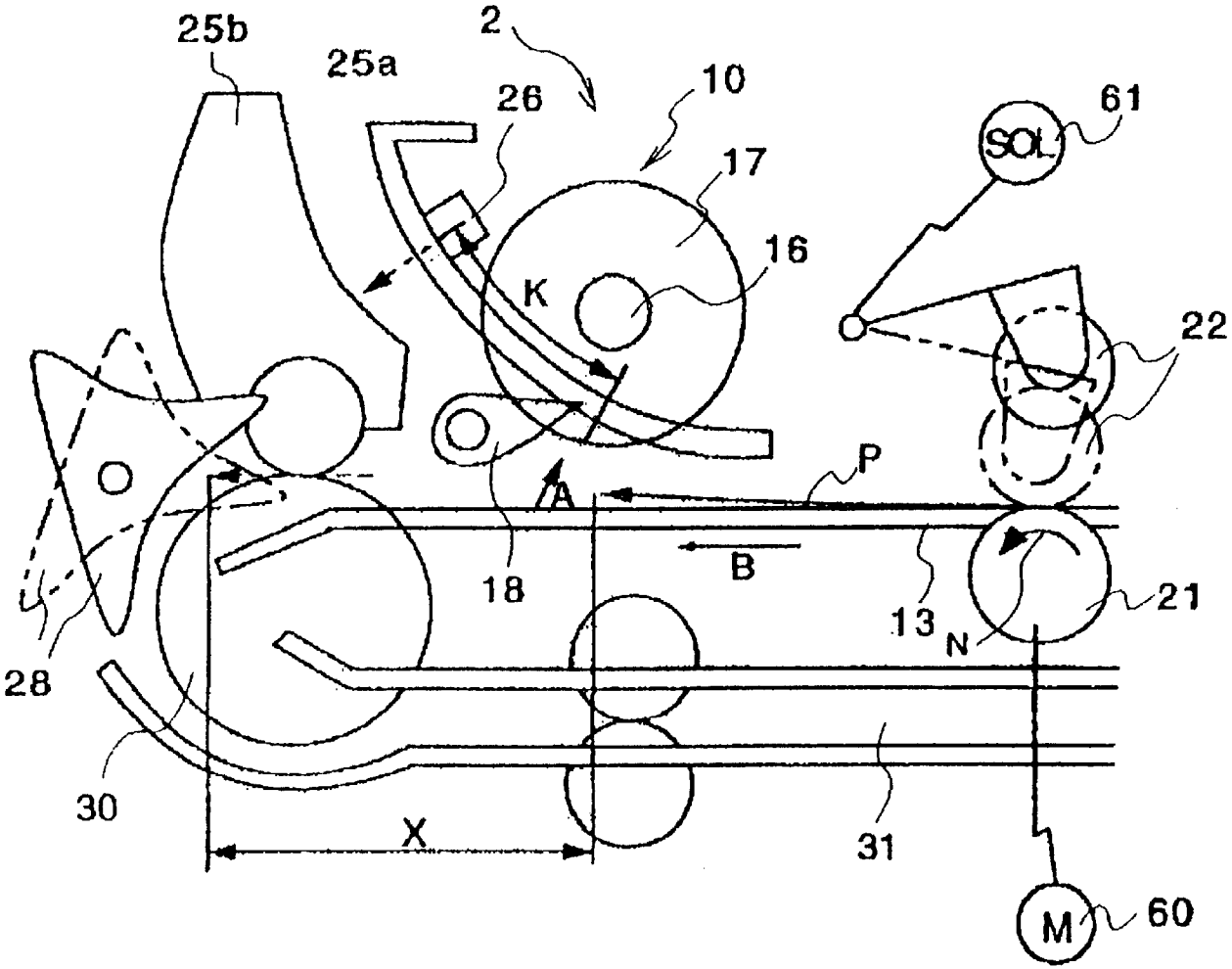
FIG. 8 shows how the sheet reversing and discharging device sends out a sheet.

The reversal of the tab sheet Pt to occur after the entry in the tray 13 will be described with reference to FIG. 8. As shown, the roller 21 is driven in the forward direction, as indicated by an arrow N, to convey the tab sheet Pt laid on the tray 13 to the duplex drive roller 30 in a direction B (send-out direction). At this time, the solenoid 61 is deenergized to retract the driven reverse roller 22 from the guide 13 and waits for the next sheet. Assume that a distance necessary for an ordinary sheet to be surely nipped is X. Then, the tab sheet Pt must be conveyed by the calculated extra amount of feed corresponding to the tab e to the downstream side. Further, when the tab sheet Pt enters the tray 13, the timing for reversal is delayed by the extra amount of feed, tending to reduce a margin available for the entry of the next sheet. The smaller the interval between sheets, the smaller the above margin and therefore the more difficult the control over the interval.

To solve the above problem, in the illustrative embodiment, the drive reverse roller 21 is accelerated to make up for the delay corresponding to the extra amount of feed δ to thereby implement the same timing for the tab sheet Pt as for an ordinary sheet. This insures reliable conveyance of the tab sheet Pt. The rotation speed of the motor 60 for the acceleration of the drive reverse roller 21 is calculated on the basis of the extra amount of feed δ derived from the output of the sheet sensor 26. Assume that the distance of conveyance X is a fixed value and that the usual conveying speed and the accelerated conveying speed are V and V', respectively. Then, a condition necessary for acceleration is expressed as:

$$V' \geqq (X+2\delta)/T \qquad \text{Eq. (4)}$$

where T is equal to X/V.

As the Eq. (4) indicates, by taking account of the extra amounts of feed at the time of "send-in for reversal" and "send-out after reversal", the illustrative embodiment accelerates the drive reverse roller 21 for making up for the loss of 2δ. The above condition for acceleration may be fixed if the configuration of tab sheets Pt to be usually used is fixed.

In the configuration described above, a jogger motor, not shown, causes the side fence or jogger 29, FIG. 4, to jog a sheet in the direction perpendicular to the direction of conveyance. More specifically, as soon as the tab sheet Pt is fully pulled in, i.e., the tab e moves away from the path selector 18, the driven reverse roller 22 is released from the drive reverse roller 21. At the same time, the side fence 29 is driven to position the tab sheet Pt. Subsequently, the driven reverse roller 22 is again pressed against the drive reverse roller 21 for conveying the tab sheet Pt. While this operation brings about some time lag, the condition for acceleration should only be determined by taking account of the time lag. The jogging action of the side fence 29 enhances positional accuracy at the time of finishing, e.g., punching to follow.

In the illustrative embodiment, the side fence 29 jogs each of the tab sheet Pt and an ordinary sheet at a particular timing. While usual control (operation) is based on ordinary sheets predominant in number over tab sheets, control is varied only for the tab sheet Pt. The difference is that the drive reverse roller 21 is accelerated to make up for the delay corresponding to the length of the tab e. This allows control over conveyance from the duplex drive roller 30 to the image forming section 1, control over conveyance at the image forming section 1 and control over sheet discharge after image formation to be executed with the tab sheet Pt at the same timing as with the ordinary sheet P.

Figure 9:
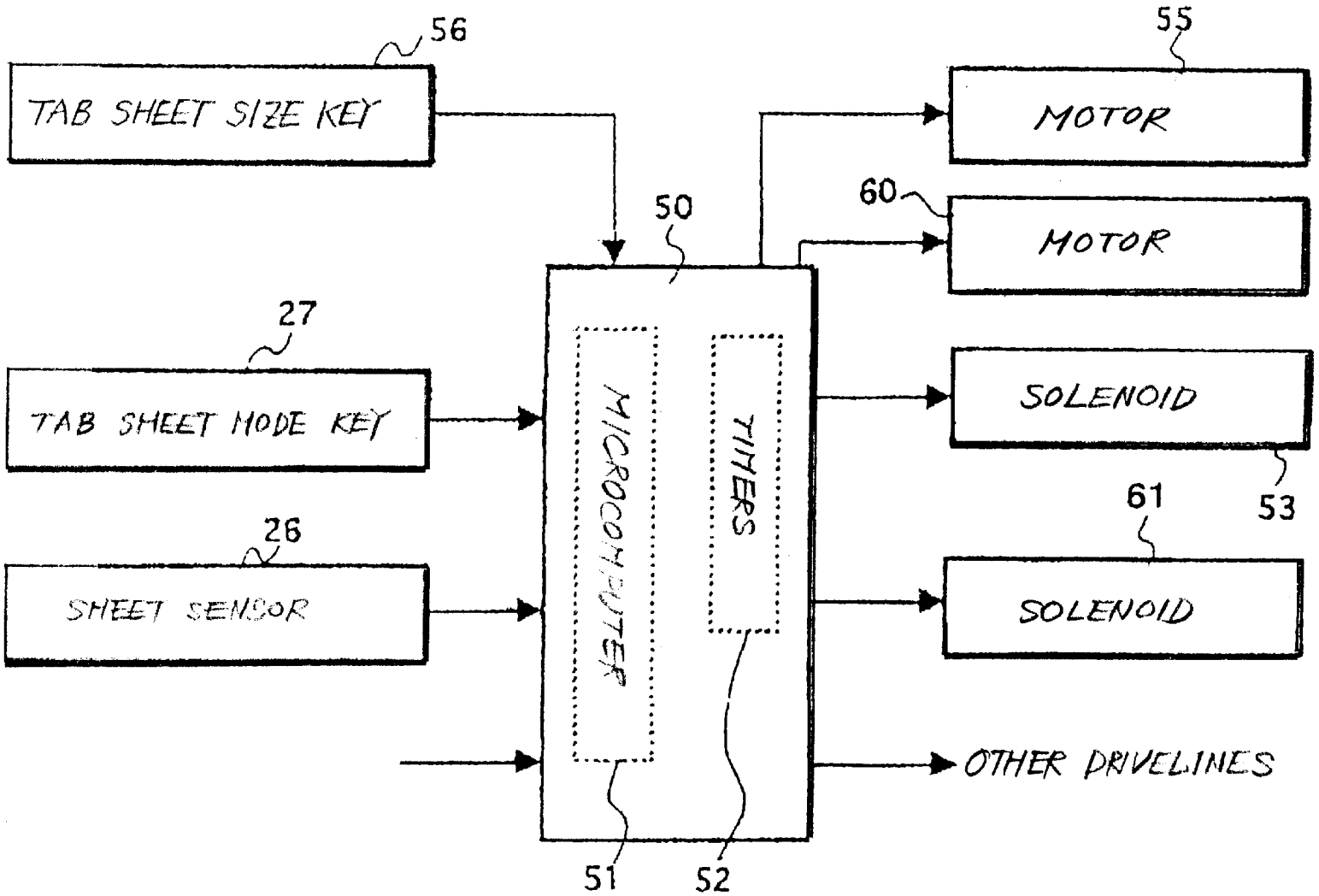
FIG. 9 is a block diagram showing a control system included in the illustrative embodiment.

FIG. 9 shows a control system included in the illustrative embodiment. As shown, the control system includes a controller 50 including a microcomputer 51 and various timers 52. The solenoids 53 and 61 and other actuators, a motor 55, the motor 60, a tab sheet size input key 56, sensors including the sheet sensor 26 and a tab sheet mode key 27 are connected to the controller 50. The controller 50 receives the outputs of the tab sheet size input key 56, tab sheet mode key 27 and sensors and feeds control signals to the motors 55 and 60 and other actuators.

The microcomputer 51 includes a CPU (Central Processing Unit), a ROM (Read Only Memory) storing a program to be executed by the CPU, a RAM (Random Access Memory) playing the role of a work area for the CPU and an I/O (Input/Output) circuit, although not shown specifically. The CPU selectively executes a continuous mode for continuously conveying the tab sheets Pt or an intermittent mode for intermittently conveying them between ordinary sheets as slip sheets. The tab sheet mode key 27 is positioned on a control panel, not shown, mounted on the apparatus PR. Assume that the operator of the apparatus PR presses the tab sheet mode key 27 in order to select a tab sheet mode. Then, the microcomputer 51 performs calculation in accordance with the outputs of the sensor 26, tab sheet mode key 27 and tab size key 56 for thereby controlling the timers and loads. The motor 55 drives the roller 17 and duplex drive roller 30 while the motor 60 drives the drive reverse roller 21. The solenoid 61 moves the driven reverse roller 22 into and out of contact with the drive reverse roller 21. The solenoid 53 causes the duplex path selector 28 to move between the two positions stated earlier.

Figure 10A:
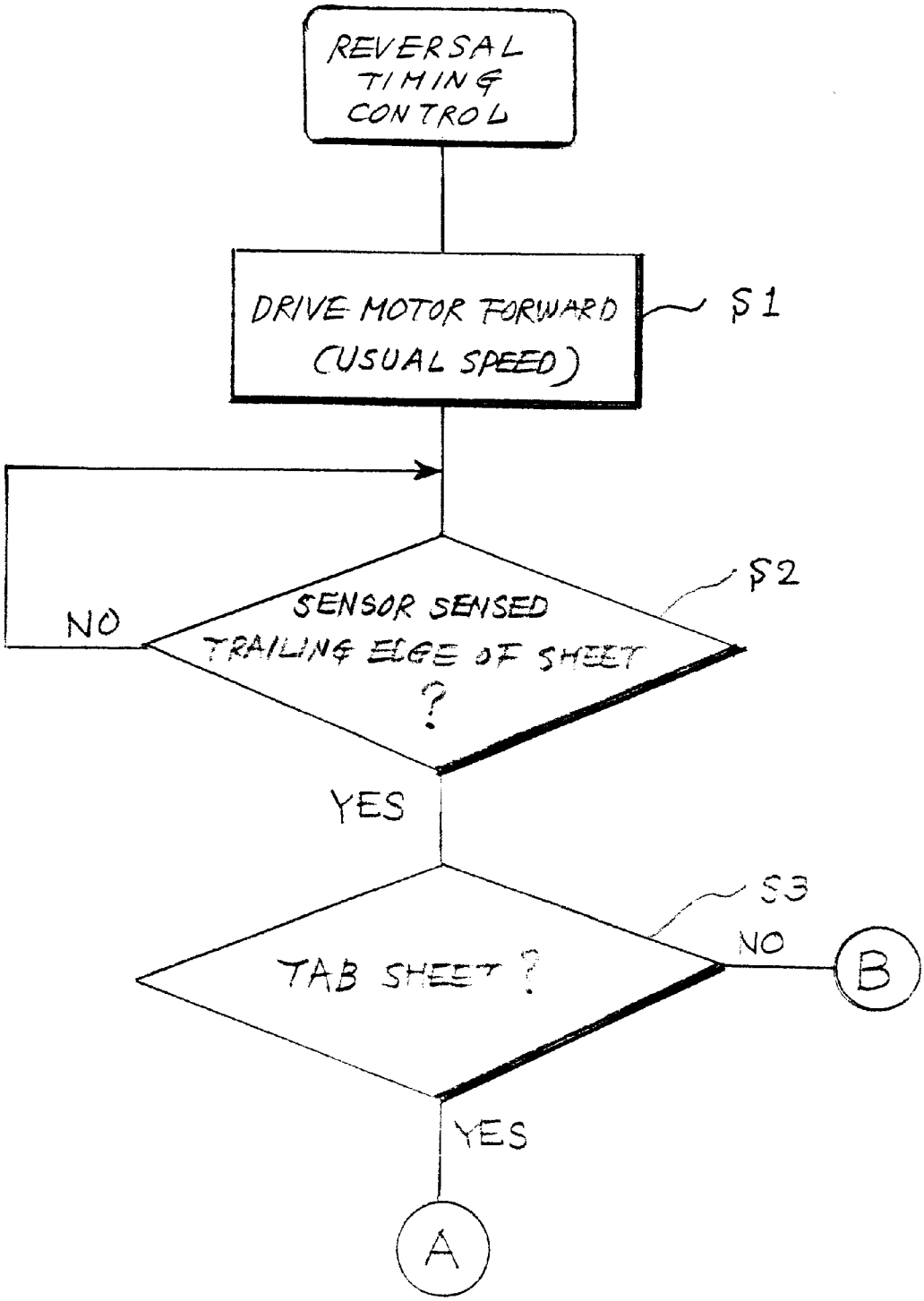
FIGS. 10A through 10C are flowcharts demonstrating a specific operation of the illustrative embodiment.
Figure 10B:
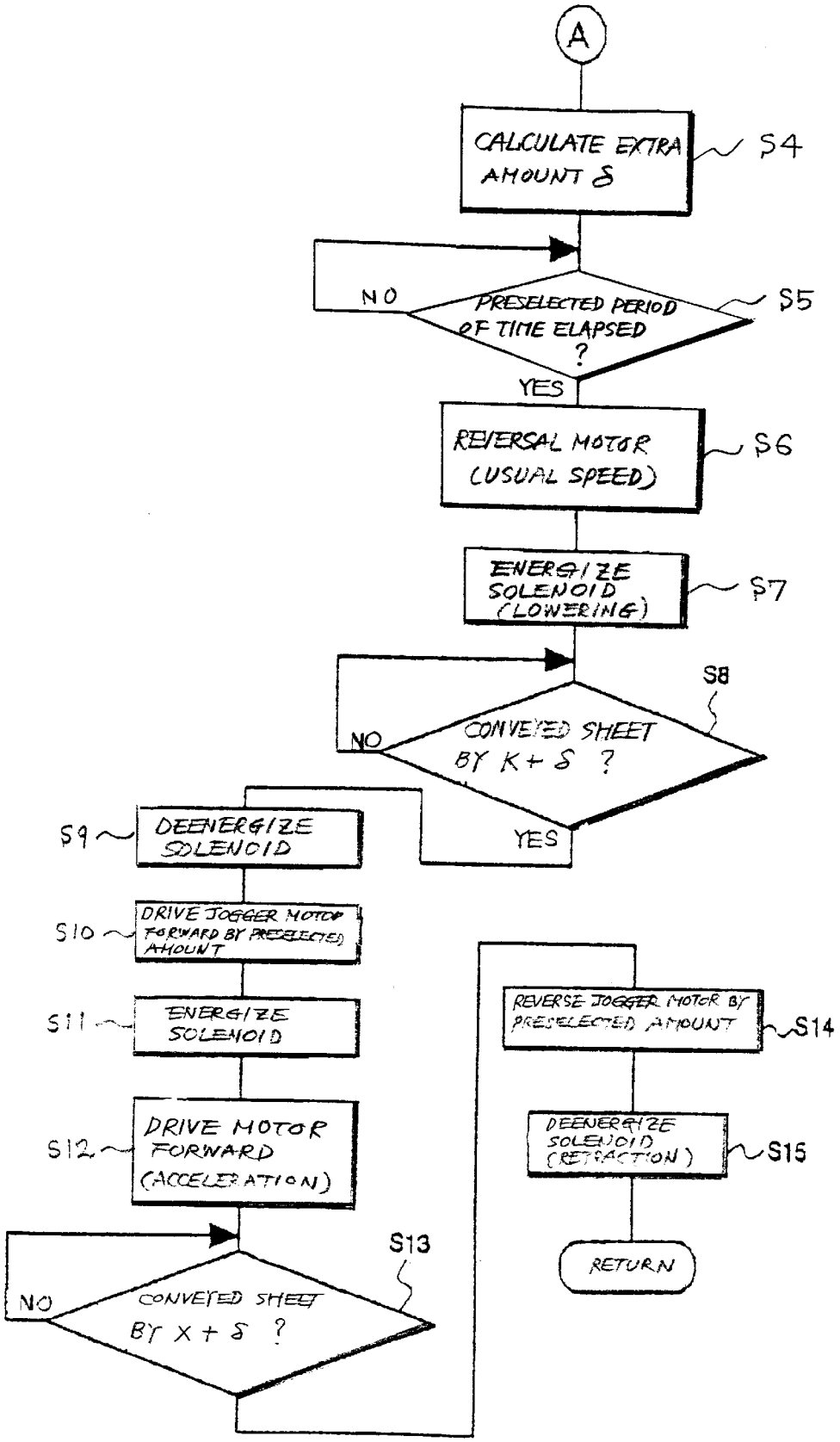
Figure 10C:
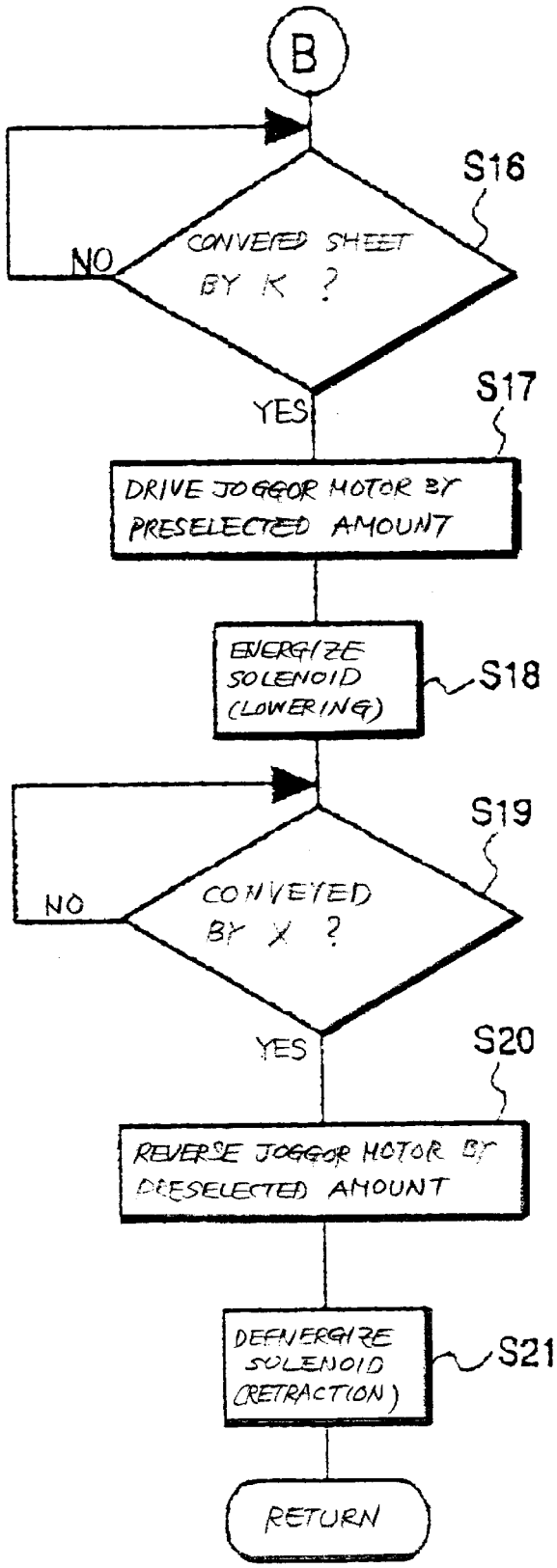

A specific operation of the illustrative embodiment will be described with reference to FIGS. 10A through 10C. As shown, the controller 50 drives the motor 60 at the usual speed V in the forward direction such that a sheet will be conveyed in the direction N, and waits for the entry of a sheet (step S1). When the sheet sensor 26 senses the trailing edge of a sheet entered the sheet reversing device 2 (YES, step S2), the controller 50 determines whether or not the sheet is a tab sheet Pt by referencing the tab sheet mode key 27 (step S3). If the answer of the step S3 is YES, then the controller 50 executes a routine A (FIG. 10B).

In the routine A, the controller 50 sets an extra amount of feed δ on the basis of the timing sensed by the sheet sensor 26 by using the Eq. (3) (step S4). On the elapse of a preselected period of time since the trailing edge of the tab sheet Tb has moved away from the sheet sensor 26 (YES, step S5), the controller 50 reverses the direction of rotation of the motor 60 while maintaining the usual speed V such that the tab sheet Pt will be conveyed in the direction R, FIG. 4, (step S6). At the same time, the controller 50 energizes the solenoid 61 to thereby bring the driven reverse roller 22 into contact with the drive reverse roller 21 (step S7). As a result, the tab sheet Pt is pulled in the direction C. After the tab sheet Pt has been conveyed by the "preselected distance K+extra amount δ" (YES, step SB), the controller 50 deenergizes the solenoid 61 for thereby releasing the driven reverse roller 22 from the drive reverse roller 21 (step S9). At the same time, the controller 50 drives the jogger motor by a preselected amount in the forward direction (step S10). As a result, the side fence 29 is brought into contact with the tab sheet Pt in the direction of conveyance to thereby push it by a preselected amount.

Subsequently, the controller 50 energizes the solenoid 61 to bring the driven reverse roller 22 into contact with the drive reverse roller 21, causing the rollers 21 and 22 to nip the tab sheet Pt (step S11). The controller 50 then drives the motor 60 in the forward direction (direction N, FIG. 3) for thereby conveying the tab sheet Pt at a speed higher than a usual speed assigned to ordinary sheets (step S12). The speed higher than the usual speed satisfies the condition for acceleration V', which is derived from the Eqs. (3) and (4). After the tab sheet Pt has been conveyed by the "preselected distance X+extra amount δ" and surely nipped by the duplex drive roller 30 (YES, step S13), the controller 50 reverses the rotation of the jogger motor by a preselected amount to retract the side fence 29 (step S14). The controller 50 then deenergizes the solenoid 61 to release the driven reverse roller 22 from the drive reverse roller 21 (step S15) and then returns. Further, the controller 50 again drives the motor 60 at the usual speed V and waits for the next sheet. It is noteworthy that the conveyance of the tab sheet Pt at the accelerated speed ends at the same timing as the conveyance of an ordinary sheet, and therefore control timings to follow are the same as the control timings of an ordinary sheet. The illustrative embodiment therefore does not need sophisticated control.

On the other hand, assume that the sheet is not the tab sheet Pt, i.e., it is an ordinary sheet P (NO, step S3). Then, the controller 50 executes a routine B (FIG. 10C). In the routine B, as soon as the sheet P is conveyed by the preselected (usual) distance K (YES, step S16), the controller 50 drives the jogger motor by a preselected amount in the forward direction to bring the side fence 29 into contact with the sheet P positioned on the guide 13 (step S17). The controller 50 then energizes the solenoid 61 at the time when the trailing edge of the sheet P moves away from the path selector 18, thereby lowering the driven reverse roller 21 toward the drive reverse roller 21 (step S18). At this time, the drive reverse roller 21 (motor 60) is still rotating at the usual speed in the forward direction (direction N, FIG. 8). After conveyance by the distance X (YES, step S19), the controller 50 reverses the rotation of the jogger motor by a preselected amount to retract the side fence 29 (step S20), deenergizes the solenoid 61 to retract the driven reverse roller 21 (step S21), and then returns.

As stated above, the controller 50 can determine, based on the output of the sheet sensor 26, a particular timing for reversal for each of the tab sheet Pt and ordinary sheet P. This makes it needless to calculate the length of a sheet and therefore realizes simple control. Further, the controller 50 controls each of the roller 21 and driven reverse roller 22 in a particular manner in accordance with the kind of a sheet. The controller 50 therefore allows the tab sheet Pt to surely enter the tray 13 and allows the ordinary sheet P to be rapidly reversed. Moreover, after the tab sheet Pt has been fully pulled in, the controller 50 causes it to be reversed at the higher speed. This implements simple control as to timings to follow, as stated earlier.

An alternative embodiment of the present invention will be described with reference to FIGS. 11A through 11C. This embodiment is also practicable with the construction described with reference to FIGS. 3 through 9. In the figures, identical structural elements are designated by identical reference numerals and will not be described specifically in order to avoid redundancy.

In the modification of the previous embodiment, the sheet sensor 26 positioned upstream of the roller 17 in the direction of conveyance senses the trailing edge of the tab sheet Pt or that of the ordinary sheet P. When the tab sheet Pt enters the tray 13 or reversal path 13, the drive reverse roller 21 and driven reverse roller 22, or conveying means, pull in the tab sheet Pt until the tab e surely moves away from the path selector 18, as determined on the basis of the sheet sensor 26. With this configuration, the modification simplifies and therefore reduces the cost of the roller and path selector configurations. In addition, the modification accelerates the conveying means during conveyance in the send-out direction in order to absorb the loss corresponding to the tab e, thereby preventing productivity from decreasing.

The above modification, however, has a problem that the degree of simple calculation achievable by sensing both of the leading edge of the tab sheet Pt and that of the ordinary sheet P for control over the timing for reversal is limited. To solve this problem, the illustrative embodiment to be described causes the sheet sensor 26 to sense the leading edge of the tab sheet Pt and sense the trailing edge of the ordinary sheet. The controller 50 calculates the extra amount of feed δ on the basis of the resulting output of the sheet sensor 26 and the length of the tab sheet Pt that is input beforehand.

Figure 11A:
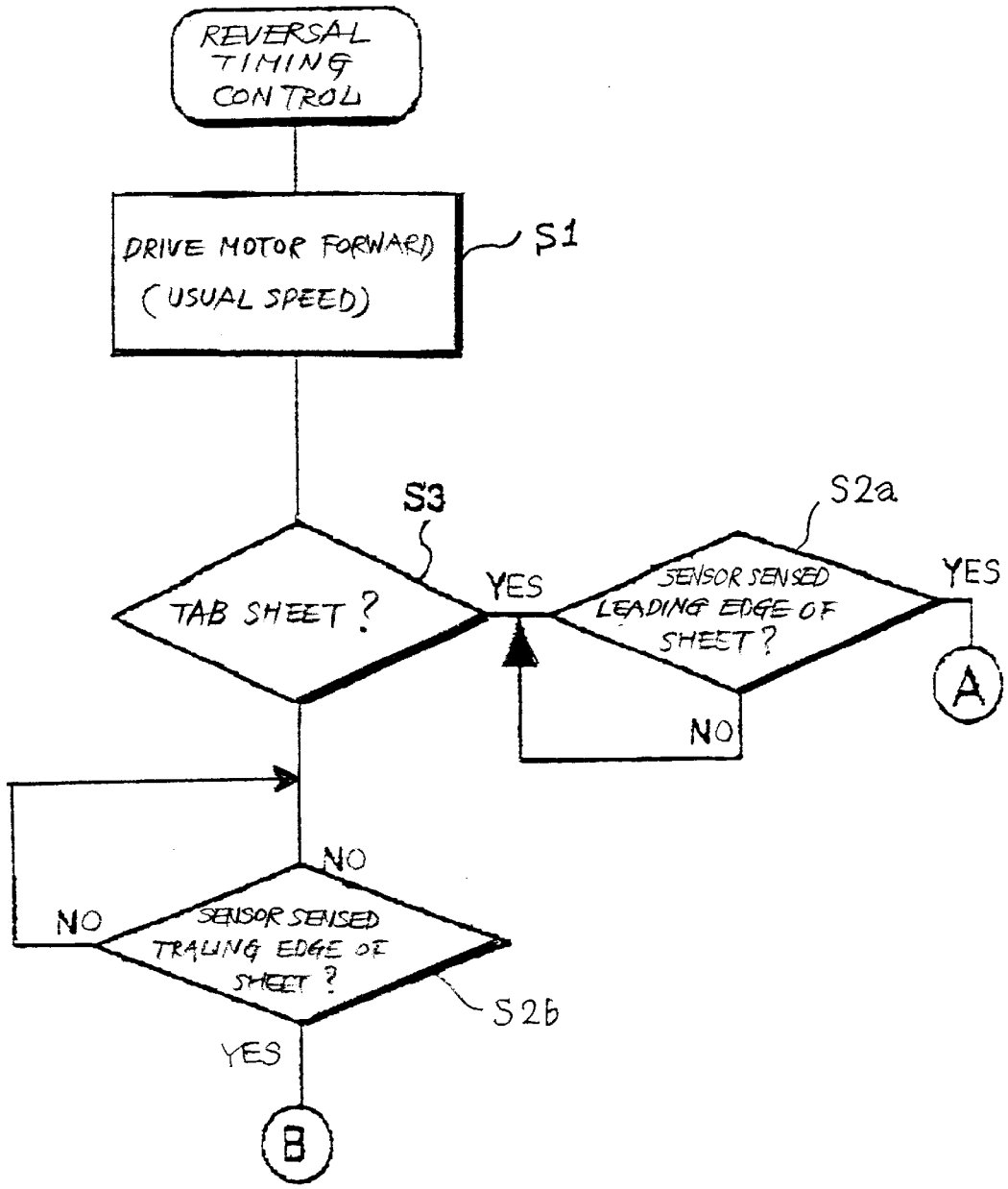
FIGS. 11A through 11C are flowcharts representative of an alternative embodiment of the present invention.
Figure 11B:
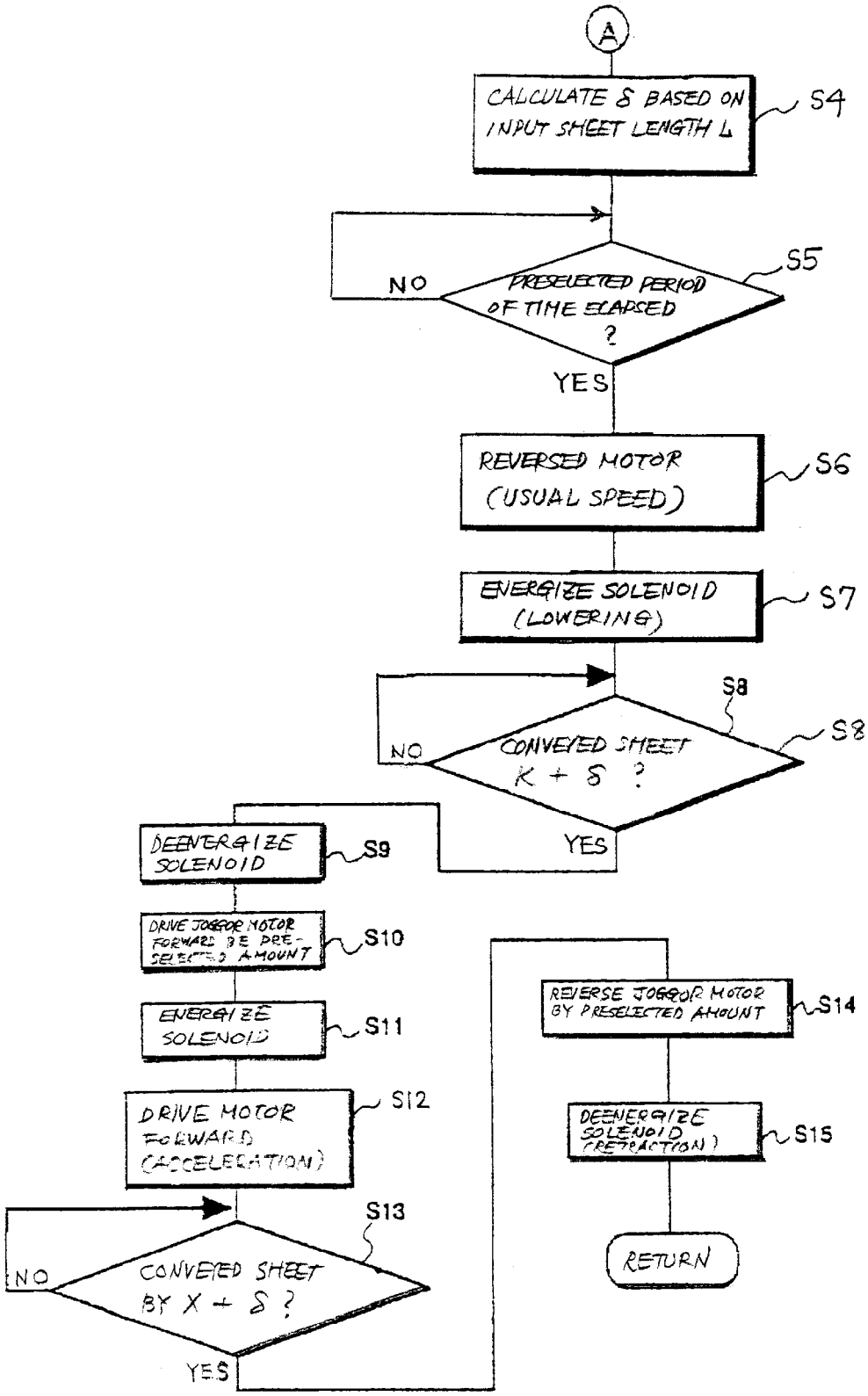
Figure 11C:
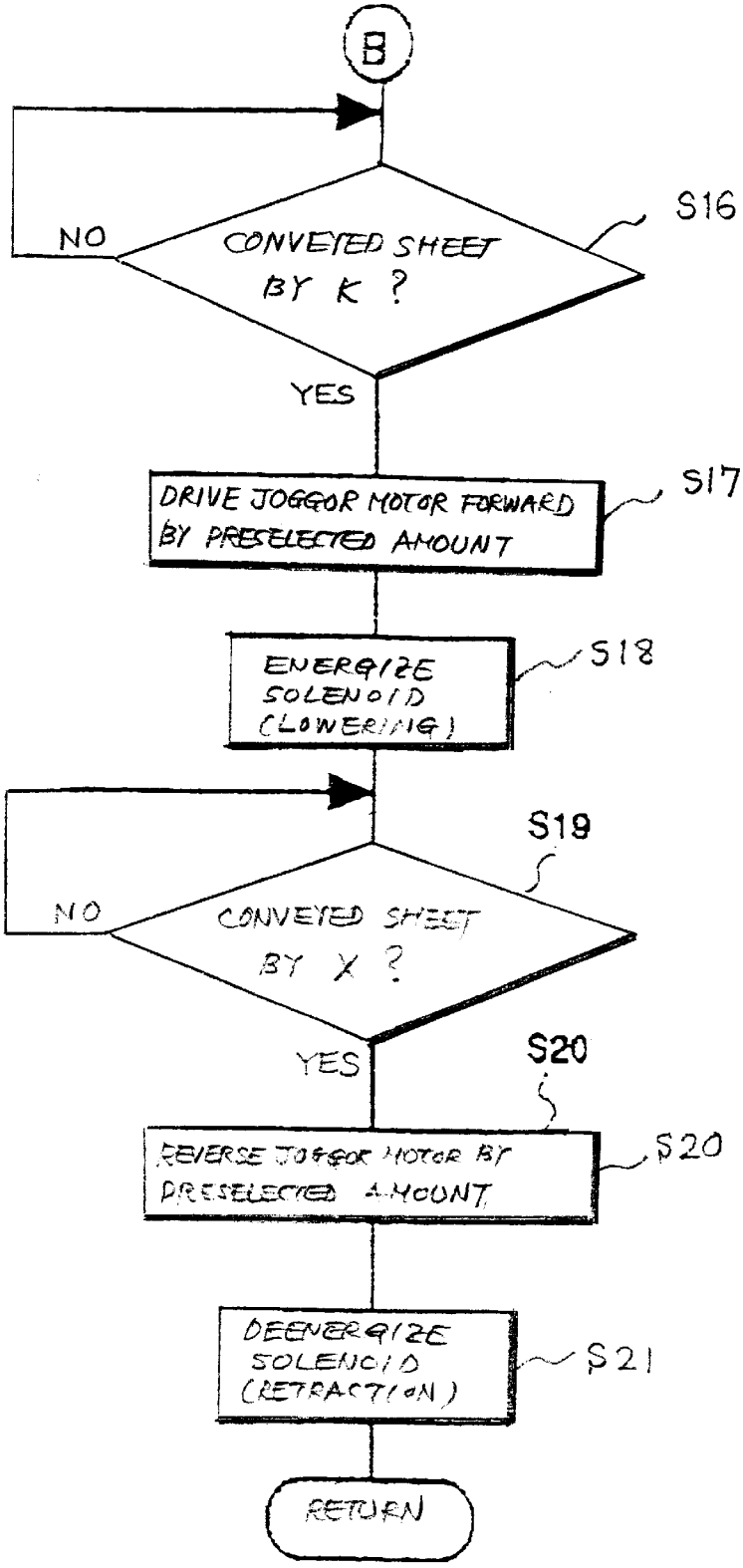

Specifically, as shown in FIG. 11A, the controller 50 drives the motor 60 at the usual speed V in the forward direction and waits for the entry of a sheet (step S1). The controller then determines whether or not the sheet sensed is the tab sheet Pt by referencing the tab sheet mode key 27 (step S3). If the answer of the step S3 is YES and when the sheet sensor 26 senses the leading edge of the tab sheet Pt (YES, step S2*a*), then the controller 50 executes a routine A (FIG. 11B). It is to be noted that the length L of the tab sheet Pt inclusive of the tab e is known beforehand on the basis of the output of the sheet size key 56.

If the answer of the step S3 is NO, meaning that the sheet is the ordinary sheet P, then the controller 50 executes a routine B (FIG. 11C) as soon as the sensor 26 senses the trailing edge of the sheet P (YES, step S2*b*).

In any case, the controller 50 calculates a condition necessary for acceleration in accordance with the output of the sheet sensor 26 by using the Eq. (4). This also allows the conveyance of the tab sheet Pt to end at the same timing as the conveyance of the ordinary sheet P, thereby simplifying control over the timings to follow.

The step S2*a* may be replaced with a step of sensing both of the leading edge and trailing edge of a sheet and then calculating the extra amount of feed δ in accordance with a period of time elapsed by using the Eqs. (1) through (4). This alternative step further promotes accurate control although it increases the number of steps and therefore slightly complicates the control.

Figure 12A:
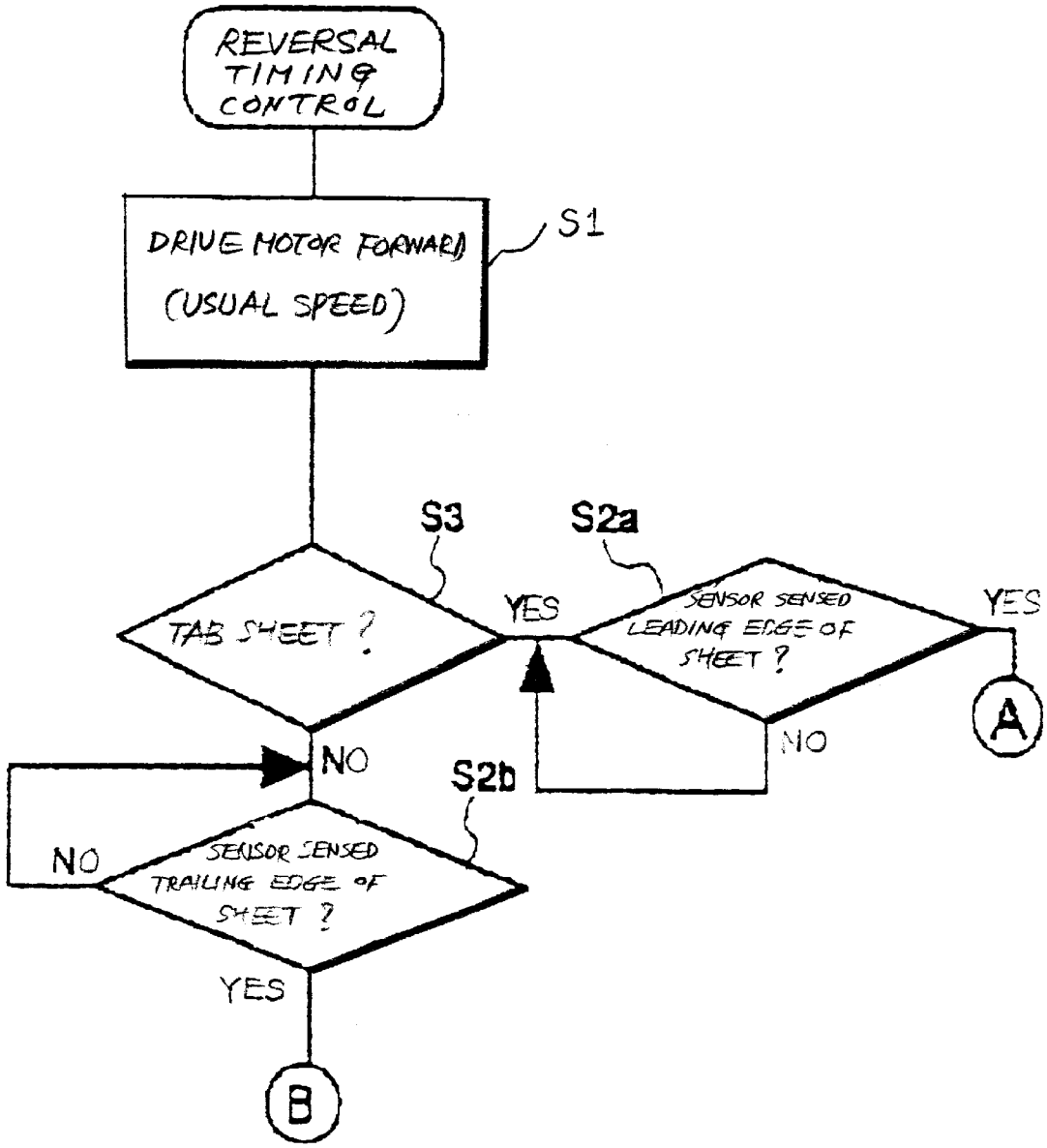
FIGS. 12A through 12C are flowcharts representative of another alternative embodiment of the present invention.
Figure 12B:
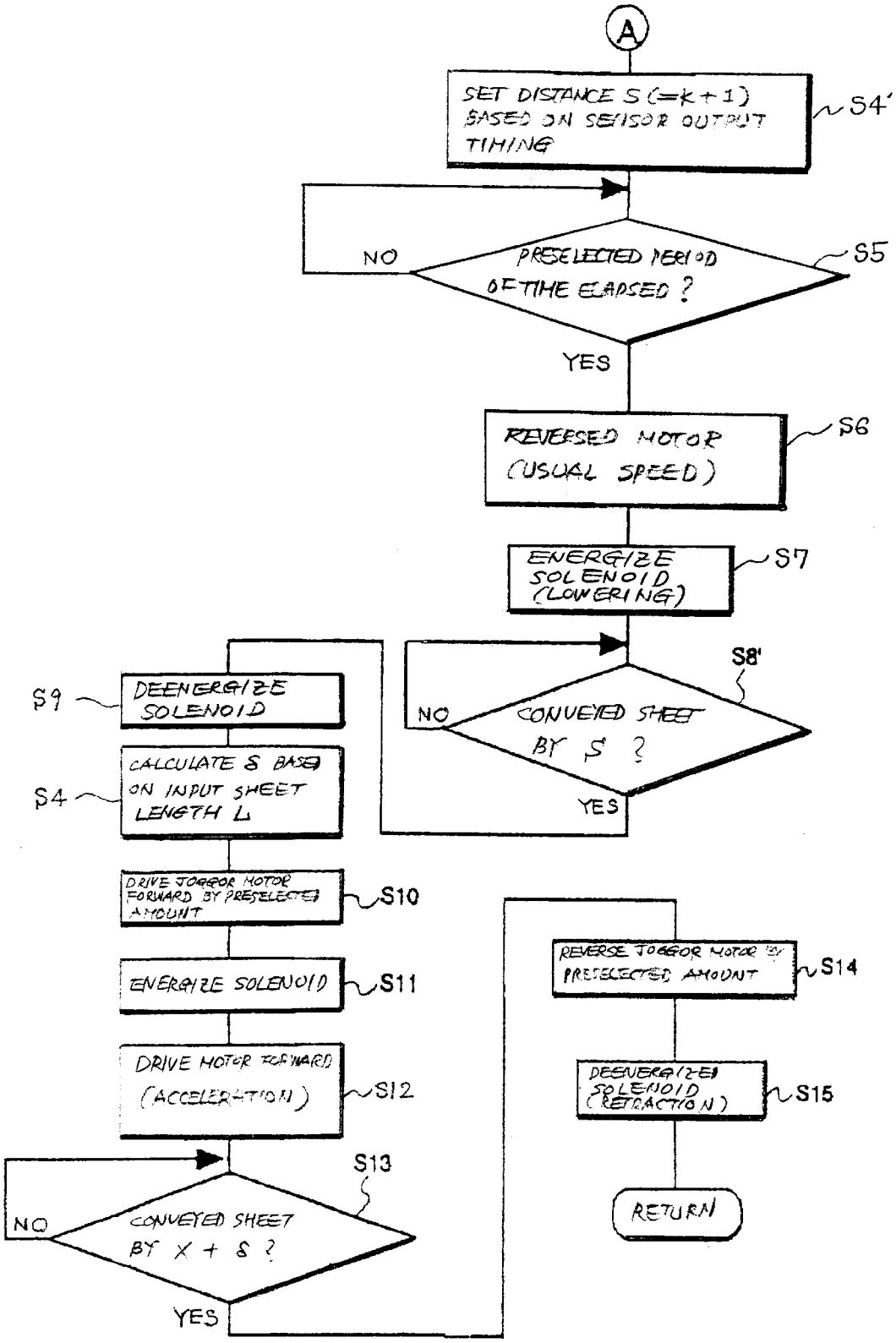
Figure 12C:
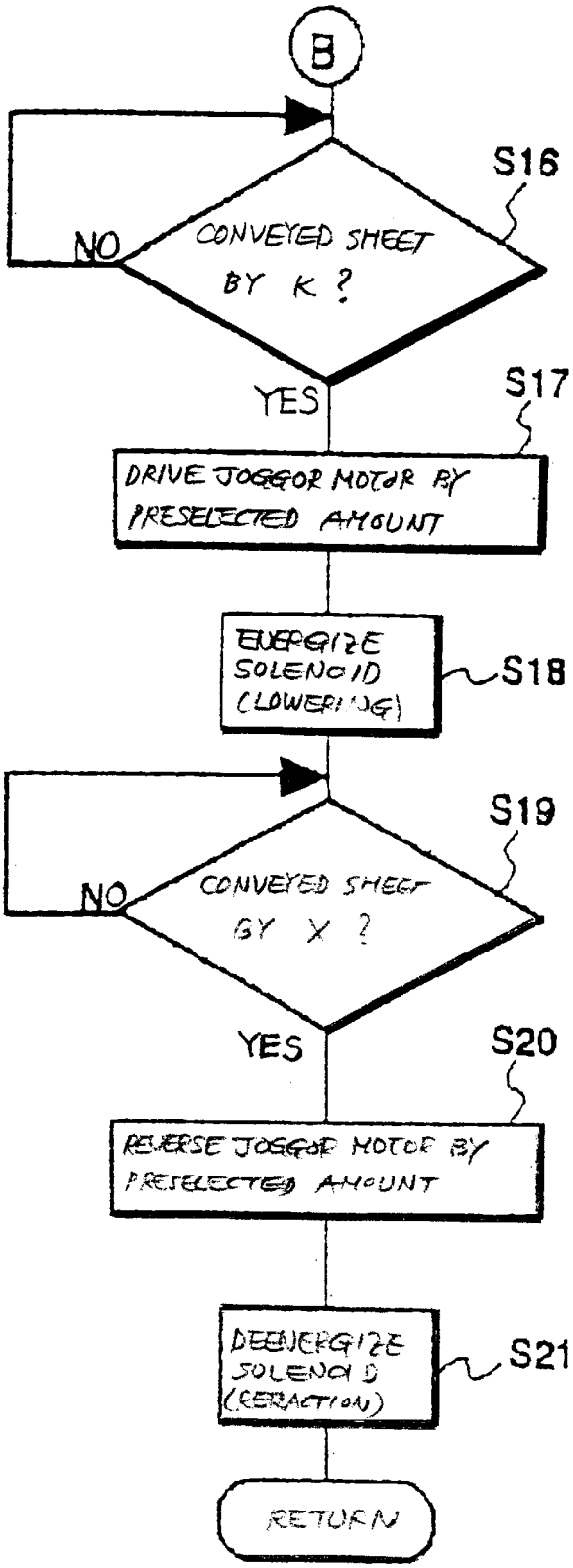

FIGS. 12A through 12C show another alternative embodiment of the present invention. This embodiment is identical with the embodiment of FIGS. 11A through 11C except that it executes the step S4 at a different timing. This embodiment is also practicable with the configurations described with reference to FIGS. 3 through 9. In the figures, identical structural elements are designated by identical reference numerals and will not be described specifically in order to avoid redundancy. Also, steps shown in FIGS. 12A through 12C identical with the steps shown in FIGS. 11A through 11C are designated by the same labels and will not be described specifically.

As shown in FIG. 12A, the controller 50 drives the motor 60 at the usual speed in the forward direction and waits for the entry of a sheet (step S1). The controller 50 then determines whether or not a sheet sensed is the tab sheet Pt by referencing the tab sheet mode key (step S3). If the answer of the step S3 is YES and when the sensor 26 senses the leading edge of the tab sheet Pt (YES, step S2*a*), the controller executes a routine A. The routine A begins with a step A' instead of the step A of FIG. 11B.

In the step S4', the controller 50 sets only a distance of conveyance S (=K+L), FIG. 6, after the sheet sensor 26 has sensed the leading edge of the tab sheet Pt. When a period of time corresponding to the distance S elapses (YES, step S5), the controller 5 executes a step 6 and successive steps. More specifically, in the steps S4' and S5, the controller 50 causes the tab sheet Pt to be conveyed until its trailing edge surely moves away from the roller 17 and path selector 18. It is to be noted that L denotes the length of the tab sheet Pt inclusive of the tab e input beforehand while L denotes the distance between the sensor 26 and the tip of the path selector 18 described in relation to the Eq. (1). This allows the sheet sensor 26 to surely sense the sheet Pt without regard to the position of the tab e.

After steps S6 and S7, the controller 50 determines whether or not the tab sheet Pt has been conveyed by the distance S (step S8'). If the answer of the step S8' is YES, then the controller 50 deenergizes the solenoid 61 (step S9), calculates an extra amount of feed δ on the basis of the length L (step S4), sets an amount of feed for reversal, and then executes a step S10 and successive steps.

If the answer of the step S3 is NO, meaning that the sheet sensed is the ordinary sheet P, then the controller 50 executes a routine B when the sensor 26 senses the trailing edge of the sheet P (YES, step S2*b*).

As stated above, the distance S set in the step S4' allows the tab e to surely move away the position between the roller 17 and path selector 18 without jamming such a position. Moreover, the extra amount of feed δ in the step S4 is calculated in the procedure up to the step S9 beforehand, so that the calculation of the extra amount δ does not delay the operation timing at all. It is to be noted that the extra amount δ may be calculated at any desired step so long as the step precedes the step S13.

Figure 13:
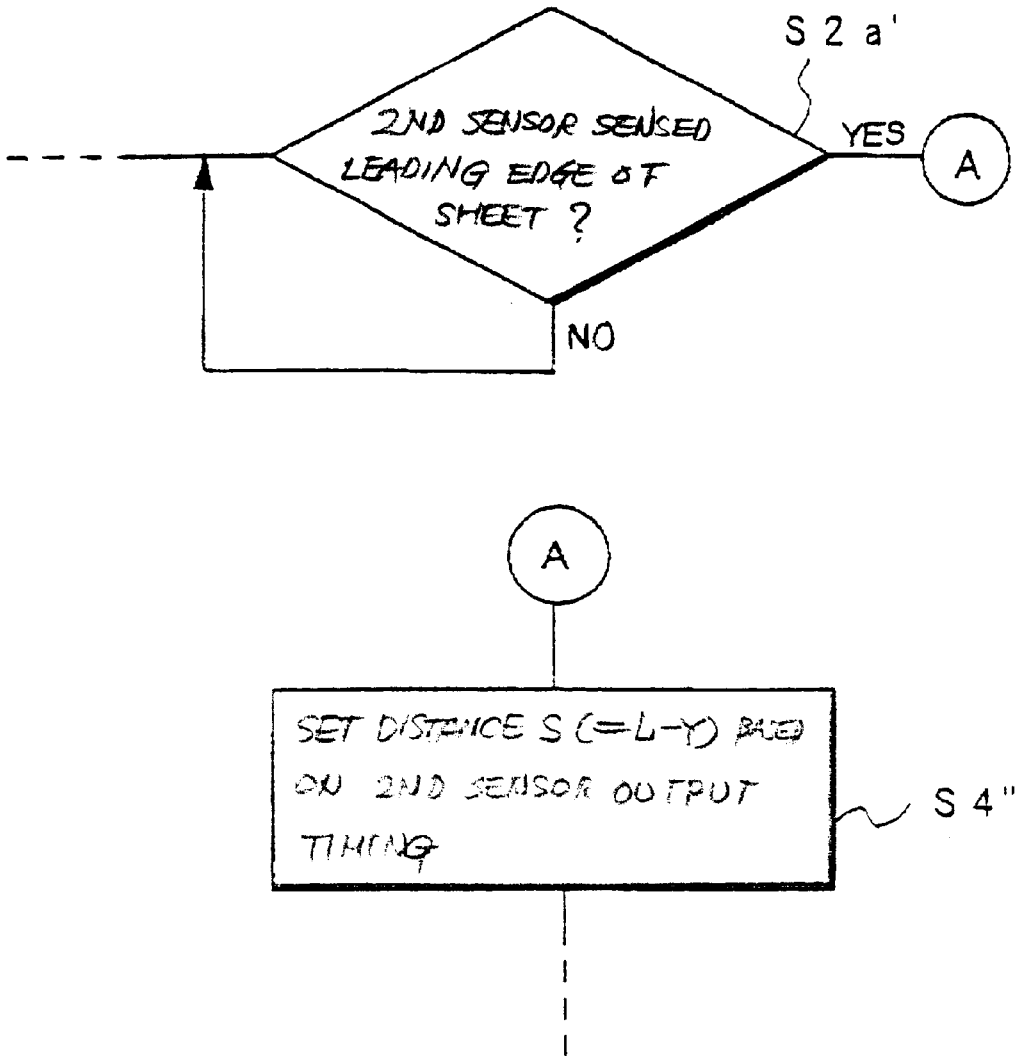
FIG. 13 is a flowchart representative of a further alternative embodiment of the present invention.

Reference will be made to FIG. 13 as well as to FIGS. 12A through 12C for describing a further alternative embodiment of the present invention. This embodiment is also practicable with the configurations shown in FIGS. 3 through 9. In the figures, identical reference numerals designate identical structural elements and will not be described specifically. In FIG. 13, steps identical with the steps of FIGS. 11A through 11C and 12A through 12C are designated by identical labels and will not be described specifically.

The previous embodiments each control the previously stated timing in accordance with the output of the sheet sensor 26, which is positioned upstream of the roller 17 and responsive to the leading edge or the trailing edge of a sheet. Usually, as for the leading edge, a feed error ascribable to, e.g., slip is more apt to occur as a distance of conveyance from a sensor becomes greater. In this respect, a sensor should preferably be positioned on the switchback path and at the downstream side as far as possible. In light of this, the embodiment to be described uses a second sensor 32 located downstream of the roller 21 in the direction of conveyance and responsive to the leading edge of a sheet (tab sheet). Control based on the output of the second sensor 32 is executed in addition to the processing described with reference to FIGS. 11A through 11C.

Assume that the sheet sensed is the tab sheet Pt (YES, step S3). Then, as shown in FIG. 13, when the second sensor 32 (FIG. 6) senses the leading edge of the tab sheet Pt (YES, step S2*a*'), the controller 50 executes the routine A of FIG. 12B. In the illustrative embodiment, in the routine A, a step S4" is substituted for the step S4'.

In the step S4", when the leading edge of the tab sheet Pt moves away from the second sensor 32, the controller 50 sets a distance of conveyance S (=L−Y). On the elapse of a period of time corresponding to the distance S (YES, step S5), the controller 50 executes the step S6 and successive steps. The steps S4" and S5 allow the trailing edge of the tab sheet Pt to surely move away from the position between the roller 17 and the path selector 18 (FIG. 6). It is to be noted that L denotes the length of the tab sheet Pt inclusive of the tab e while Y denotes the distance between the tip of the path selector 18 and the second sensor 32. The leading edge of the tab sheet Pt is therefore sensed after the leading edge has been sufficiently nipped between the drive reverse roller and the driven reverse roller 22, i.e., when a sufficient conveying force acts on the leading edge. Then, time starts being counted (step S5). The tab sheet Pt can therefore be surely reversed even when some slip (sheet delay) occurs before the nip between the two rollers 21 and 22.

On the elapse of the preselected period of time (YES, step S5), the controller 50 causes the tab sheet Pt to be conveyed by the distance S. This is followed by the step S6 and successive steps.

If the sheet sensed is not the tab sheet Pt, meaning that the sheet is the ordinary sheet P (NO, step S3), the controller 50 executes the routine B when the sensor 26 senses the trailing edge of the step P (step S2*b*).

In summary, it will be seen that the present invention provides a sheet reversing device and an image forming apparatus including the same that have various unprecedented advantages, as enumerated below.

(1) As for a tab sheet, only if the length of a tab in the direction of conveyance and that of the entire sheet in the same direction are known, then a time when the sheet moves away from delivering means can be calculated on the basis of a time when the leading edge of the sheet has been sensed. A timing for reversal is set on the basis of the calculated time. As for an ordinary sheet, the sheet can move away from the delivering means in the shortest period of time if its trailing edge is sensed. The tab sheet and ordinary sheets are therefore little susceptible to, e.g., slip ascribable to the delivering means and can be reversed with accuracy.

(2) A tab sheet can be reliably conveyed while an ordinary sheet can be reversed as soon as its trailing edge moves away from the delivering means. The tab sheet and ordinary sheet can therefore be efficiently reversed.

(3) In the case of a tab sheet, a drive roller is driven in the send-in direction for delivering the sheet to a reverse path, until the trailing edge of the sheet, i.e., the trailing edge of a tab moves away from the delivering means. At this instant, a driven roller presses the tab sheet against the drive roller to thereby surely convey the sheet. On the other hand, an ordinary sheet does not obstruct conveyance at all. In this case, the drive roller is constantly driven in the send-out direction, and the sheet is conveyed to the reverse path when the driven roller is released from the drive roller. The sheet, whether it be a tab sheet or an ordinary sheet, can therefore be reliably released to the reverse path. Assume that the driven roller is brought into contact with the drive roller being constantly driven in the send-out direction. Then, the sheet is immediately conveyed to the send-out direction, minimizing the loss of time.

(4) A tab sheet and an ordinary sheet differ in length from each other by the length of a tab, so that timings are set in consideration of the difference. This prevents the tab of the tab sheet from obstructing reliable conveyance and allows the ordinary sheet to be reversed at an earlier timing than the tab sheet, thereby preventing from productivity from being lowered.

(5) Second sheet sensing means senses the leading edge of a sheet being nipped by the delivering means. The sensing means therefore promotes accurate control over reversal without being effected by, e.g., the slip of the sheet.

(6) A simple configuration suffices for the delivery of a sheet into the reversal path and the prevention of the movement of the sheet in the opposite direction at the time of reversal.

(7) A sheet is sent out or conveyed by the driven roller after being jogged on the reversal path. This improves the accuracy of steps to follow.

(8) A tab sheet leaves the reversal path at the same timing as an ordinary sheet and can therefore be controlled at the same timing as an ordinary sheet thereafter.

(9) Simple control suffices for duplex printing without lowering productivity. This is true both when images are formed only on tab sheets and when images are formed on tab sheets mixed with ordinary sheets as slip sheets.

(10) It is not necessary to calculate the length of a sheet on the basis of sensor output for control over reversal.

(11) The operator of the apparatus can input mode information and the length of a tab sheet necessary for control. Therefore, the apparatus, when implemented as a stand-alone apparatus, can efficiently form images on both sides of a tab sheet or slip sheet with simple control.

(12) When the apparatus receives a print command from, e.g., a personal computer or similar apparatus connected thereto via communicating means, the apparatus can efficiently form images on both sides of a tab sheet inserted as a slip sheet with simple control. The mode information may be input on the personal computer, if desired.

Various modifications will become possible for those skilled in the art after receiving the teachings of the present disclosure without departing from the scope thereof.

What is claimed is:

1. A method of reversing an incoming sheet and then discharging said sheet, comprising:

(a) preparing a reversal path for receiving a sheet carrying an image on one side thereof and then reversing said sheet, the reversal path including delivering means for delivering the sheet to said reversal path and conveying means arranged on said reversal path for reversing the sheet delivered by said delivering means and then conveying said sheet;

(b) causing, if the sheet is a tab sheet, said conveying means to pull said tab sheet into said reversal path and then reversing said tab sheet when a trailing edge of said tab sheet moves away from said delivering means; and (c) maintaining, if the sheet is not a tab sheet, drive of said conveying means in a send-out direction at a time of delivery of said sheet by said delivering means and then applying a driving force of said conveying means to said sheet when said sheet moves away from said delivering means for thereby reversing said sheet.

2. A device for reversing a sheet and then discharging said sheet, said device comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller; and control means for causing, if the sheet is a tab sheet, said drive means to continuously drive said drive roller in a send-in direction until a tab of said tab sheet moves away from said delivering means or causing, if said sheet is not a tab sheet, said drive means to drive said drive roller in a send-out direction both when said sheet is sent in and when said sheet is sent out.

3. The device as claimed in claim 2, wherein said driven roller presses the sheet against said drive roller when the sheet is not a tab sheet.

4. The device as claimed in claim 2, wherein if the sheet is not a tab sheet, said driven roller is retracted from said drive roller when said sheet is sent into said reversal path.

5. The device as claimed in claim 4, wherein said delivering means comprises a plurality of rollers and a plurality of fingers each being arranged between nearby ones of said plurality of rollers, and said plurality of fingers press, in the event of send-in of the sheet, said sheet against said plurality of rollers to thereby exert a conveying force on said sheet or obstruct, in the event of send-out, conveyance of said sheet toward said inlet of said conveyance path.

6. The device as claimed in claim 4, further comprising:

jogging means for jogging the sheet entered said reversal path in a direction perpendicular to a direction in which said sheet is delivered to said reversal path; and control means for causing said jogging means to jog the sheet after said sheet has moved away from said delivering means.

7. The device as claimed in claim 6, wherein said driven roller is released from said drive roller after said jogging means has jogged the sheet.

8. The device as claimed in claim 2, wherein said delivering means comprises a plurality of rollers and a plurality of fingers each being arranged between nearby ones of said plurality of rollers, and said plurality of fingers press, in the event of send-in of the sheet, said sheet against said plurality of rollers to thereby exert a conveying force on said sheet or obstruct, in the event of send-out, conveyance of said sheet toward said inlet of said conveyance path.

9. The device as claimed in claim 2, further comprising:

jogging means for jogging the sheet entered said reversal path in a direction perpendicular to a direction in which said sheet is delivered to said reversal path; and control means for causing said jogging means to jog the sheet after said sheet has moved away from said delivering means.

10. The device as claimed in claim 9, wherein said driven roller is released from said drive roller after said jogging means has jogged the sheet.

11. A device for reversing a sheet and then discharging said sheet, said device comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller;

first sheet sensing means positioned upstream of said delivering means in a direction in which the sheet is delivered; and control means for setting a particular reversal timing for each of a tab sheet and a sheet other than said tab sheet in accordance with a time when said first sheet sensing means senses a leading edge of said sheet.

12. The device as claimed in claim 11, wherein said delivering means comprises a plurality of rollers and a plurality of fingers each being arranged between nearby ones of said plurality of rollers, and said plurality of fingers press, in the event of send-in of the sheet, said sheet against said plurality of rollers to thereby exert a conveying force on said sheet or obstruct, in the event of send-out, conveyance of said sheet toward said inlet of said conveyance path.

13. The device as claimed in claim 11, further comprising:

jogging means for jogging the sheet entered said reversal path in a direction perpendicular to a direction in which said sheet is delivered to said reversal path; and control means for causing said jogging means to jog the sheet after said sheet has moved away from said delivering means.

14. The device as claimed in claim 13, wherein said driven roller is released from said drive roller after said jogging means has jogged the sheet.

15. The device as claimed in claim 11, wherein if the sheet is a tab sheet, then said control means sets a timing for reversal delayed from a timing for reversal assigned to a sheet other than said tab sheet by at least a length of a tab of said tab sheet in a direction of sheet conveyance.

16. The device as claimed in claim 15, wherein if the sheet is a tab sheet, then said control means increases a conveying speed of said conveying means in a preselected section in the event of send-out.

17. The device as claimed in claim 16, wherein said control means increases the conveying speed such that the tab sheet moves away from said conveying means at a same timing as the sheet other than said tab sheet.

18. A device for reversing a sheet and then discharging said sheet, said device comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller;

first sheet sensing means positioned upstream of said delivering means in a direction in which the sheet is delivered; and control means for setting a timing for reversal for a tab sheet in accordance with a time when said first sheet sensing means senses a leading edge of said tab sheet or setting a timing for reversal for a sheet other than a tab sheet in accordance with a time when said first sheet sensing means senses a trailing edge of said sheet.

19. The device as claimed in claim 18, wherein said delivering means comprises a plurality of rollers and a plurality of fingers each being arranged between nearby ones of said plurality of rollers, and said plurality of fingers press, in the event of send-in of the sheet, said sheet against said plurality of rollers to thereby exert a conveying force on said sheet or obstruct, in the event of send-out, conveyance of said sheet toward said inlet of said conveyance path.

20. The device as claimed in claim 18, further comprising:

jogging means for jogging the sheet entered said reversal path in a direction perpendicular to a direction in which said sheet is delivered to said reversal path; and control means for causing said jogging means to jog the sheet after said sheet has moved away from said delivering means.

21. The device as claimed in claim 20, wherein said driven roller is released from said drive roller after said jogging means has jogged the sheet.

22. The device as claimed in claim 18, wherein if the sheet is a tab sheet, then said control means sets a timing for reversal delayed from a timing for reversal assigned to a sheet other than said tab sheet by at least a length of a tab of said tab sheet in a direction of sheet conveyance.

23. The device as claimed in claim 22, wherein if the sheet is a tab sheet, then said control means increases a conveying speed of said conveying means in a preselected section in the event of send-out.

24. The device as claimed in claim 23, wherein said control means increases the conveying speed such that the tab sheet moves away from said conveying means at a same timing as the sheet other than said tab sheet.

25. A device for reversing a sheet and then discharging said sheet, said device comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller;

second sheet sensing means positioned downstream of said delivering means in a direction of sheet delivery; and control means for setting a timing for reversal in accordance with a time when said second sheet sensing means senses a leading edge of the sheet.

26. The device as claimed in claim 25, wherein said delivering means comprises a plurality of rollers and a plurality of fingers each being arranged between nearby ones of said plurality of rollers, and said plurality of fingers press, in the event of send-in of the sheet, said sheet against said plurality of rollers to thereby exert a conveying force on said sheet or obstruct, in the event of send-out, conveyance of said sheet toward said inlet of said conveyance path.

27. The device as claimed in claim 25, further comprising:

jogging means for jogging the sheet entered said reversal path in a direction perpendicular to a direction in which said sheet is delivered to said reversal path; and control means for causing said jogging means to jog the sheet after said sheet has moved away from said delivering means.

28. The device as claimed in claim 27, wherein said driven roller is released from said drive roller after said jogging means has jogged the sheet.

29. The device as claimed in claim 25, wherein if the sheet is a tab sheet, then said control means sets a timing for reversal delayed from a timing for reversal assigned to a sheet other than said tab sheet by at least a length of a tab of said tab sheet in a direction of sheet conveyance.

30. The device as claimed in claim 29, wherein if the sheet is a tab sheet, then said control means increases a conveying speed of said conveying means in a preselected section in the event of send-out.

31. The device as claimed in claim 30, wherein said control means increases the conveying speed such that the tab sheet moves away from said conveying means at a same timing as the sheet other than said tab sheet.

32. An image forming apparatus for forming images on both sides of a sheet, said image forming apparatus comprising:

image forming means for forming images on the sheet; and sheet reversing and discharging means for reversing the sheet delivered thereto and then discharging said sheet;

said sheet reversing and discharging means comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller; and control means for causing, if the sheet is a tab sheet, said drive means to continuously drive said drive roller in a send-in direction until a tab of said tab sheet moves away from said delivering means or causing, if said sheet is not a tab sheet, said drive means to drive said drive roller in a send-out direction both when said sheet is sent in and when said sheet is sent out.

33. The apparatus as claimed in claim 32, wherein said sheet reversing and discharging means further comprises storing means for storing mode information showing whether or not a tab sheet mode is selected and a length of a tab sheet in said tab sheet mode, and said control means controls a timing for reversal and drive of said conveying means in accordance with the information stored in said storing means.

34. The apparatus as claimed in claim 33, wherein said sheet reversing and discharging means further comprises means for allowing an operator of said apparatus to input the mode information and the length of the tab sheet.

35. The apparatus as claimed in claim 33, wherein said sheet reversing and discharging means further comprises means for receiving the mode information and the length of the tab sheet input from another apparatus connected to said apparatus.

36. An image forming apparatus for forming images on both sides of a sheet, said image forming apparatus comprising:

image forming means for forming images on the sheet; and sheet reversing and discharging means for reversing the sheet delivered thereto and then discharging said sheet;

said sheet reversing and discharging means comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller;

first sheet sensing means positioned upstream of said delivering means in a direction in which the sheet is delivered; and control means for setting a particular reversal timing for each of a tab sheet and a sheet other than said tab sheet in accordance with a time when said first sheet sensing means senses a leading edge of said sheet.

37. The apparatus as claimed in claim 36, wherein said sheet reversing and discharging means further comprises storing means for storing mode information showing whether or not a tab sheet mode is selected and a length of a tab sheet in said tab sheet mode, and said control means controls a timing for reversal and drive of said conveying means in accordance with the information stored in said storing means.

38. The apparatus as claimed in claim 37, wherein said sheet reversing and discharging means further comprises means for allowing an operator of said apparatus to input the mode information and the length of the tab sheet.

39. The apparatus as claimed in claim 37, wherein said sheet reversing and discharging means further comprises means for receiving the mode information and the length of the tab sheet input from another apparatus connected to said apparatus.

40. An image forming apparatus for forming images on both sides of a sheet, said image forming apparatus comprising:

image forming means for forming images on the sheet; and sheet reversing and discharging means for reversing the sheet delivered thereto and then discharging said sheet;

said sheet reversing and discharging means comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller;

first sheet sensing means positioned upstream of said delivering means in a direction in which the sheet is delivered; and control means for setting a timing for reversal for a tab sheet in accordance with a time when said first sheet sensing means senses a leading edge of said tab sheet or setting a timing for reversal for a sheet other than a tab sheet in accordance with a time when said first sheet sensing means senses a trailing edge of said sheet.

41. The apparatus as claimed in claim 40, wherein said sheet reversing and discharging means further comprises storing means for storing mode information showing whether or not a tab sheet mode is selected and a length of a tab sheet in said tab sheet mode, and said control means controls a timing for reversal and drive of said conveying means in accordance with the information stored in said storing means.

42. The apparatus as claimed in claim 41, wherein said sheet reversing and discharging means further comprises means for allowing an operator of said apparatus to input the mode information and the length of the tab sheet.

43. The apparatus as claimed in claim 41, wherein said sheet reversing and discharging means further comprises means for receiving the mode information and the length of the tab sheet input from another apparatus connected to said apparatus.

44. An image forming apparatus for forming images on both sides of a sheet, said image forming apparatus comprising:

image forming means for forming images on the sheet; and sheet reversing and discharging means for reversing the sheet delivered thereto and then discharging said sheet;

said sheet reversing and discharging means comprising:

a reversal path for receiving a sheet carrying an image on one side thereof and then reversing said sheet;

delivering means adjoining an inlet of said reversal path for delivering the sheet to said reversal path;

conveying means comprising a drive roller and a driven roller for selectively further pulling the sheet entered said reversal path into said reversal path or conveying said sheet out of said reversal path after receiving said sheet, and drive means for driving said drive roller;

second sheet sensing means positioned downstream of said delivering means in a direction of sheet delivery; and control means for setting a timing for reversal in accordance with a time when said second sheet sensing means senses a leading edge of the sheet.

45. The apparatus as claimed in claim 44, wherein said sheet reversing and discharging means further comprises storing means for storing mode information showing whether or not a tab sheet mode is selected and a length of a tab sheet in said tab sheet mode, and said control means controls a timing for reversal and drive of said conveying means in accordance with the information stored in said storing means.

46. The apparatus as claimed in claim 45, wherein said sheet reversing and discharging means further comprises means for allowing an operator of said apparatus to input the mode information and the length of the tab sheet.

47. The apparatus as claimed in claim 45, wherein said sheet reversing and discharging means further comprises means for receiving the mode information and the length of the tab sheet input from another apparatus connected to said apparatus.

48. A method of providing a reversal path adapted to receive a sheet and to discharge the sheet, the method comprising:

providing a path selector adapted to deliver the sheet to the reversal path; and providing a drive roller in the reversal path adapted to both (i) rotate in a first direction to discharge the sheet out of the reversal path prior to an entry of the sheet into the reversal path when the sheet does not include a tab, and (ii) rotate in a second direction to receive the sheet into the reversal path and to subsequently rotate in the first direction after the sheet is disposed away from the path selector when the sheet includes a tab.

49. An image forming apparatus adapted to form images on both sides of a sheet, comprising:

a reversal path adapted to receive the sheet and to discharge the sheet;

a path selector adapted to deliver the sheet to the reversal path;

a drive roller disposed in the reversal path adapted to rotate in a first direction to discharge the sheet and a second direction to receive the sheet into the reversal path; and a control system adapted to (i) rotate the drive roller in the first direction prior to an entry of the sheet into the reversal path when the sheet does not include a tab, and (ii) rotate the drive roller in the second direction and to subsequently rotate the drive roller in the first direction after the sheet is disposed away from the path selector when the sheet includes a tab.

* * * * *